US006830879B2

(12) United States Patent
Suzuki et al.

(10) Patent No.: US 6,830,879 B2
(45) Date of Patent: Dec. 14, 2004

(54) PHOTOTHERMOGRAPHIC MATERIAL

(75) Inventors: Ryo Suzuki, Minami-ashigara (JP); Keiichi Suzuki, Minami-ashigara (JP); Yoshiharu Yabuki, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/210,106

(22) Filed: Aug. 2, 2002

(65) Prior Publication Data

US 2003/0129550 A1 Jul. 10, 2003

(30) Foreign Application Priority Data

Aug. 3, 2001 (JP) ..... 2001-237006

(51) Int. Cl.[7] ..... G03C 1/498; G03C 1/83

(52) U.S. Cl. ..... 430/522; 430/517; 430/617; 430/619

(58) Field of Search ..... 430/517, 522, 430/617, 619

(56) References Cited

U.S. PATENT DOCUMENTS

| | | | | | |
|---|---|---|---|---|---|
| 4,933,269 | A | * | 6/1990 | Parton et al. | 430/522 |
| 5,459,265 | A | * | 10/1995 | Wariishi et al. | 430/522 |
| 6,060,228 | A | | 5/2000 | Suzuki | 430/522 |
| 6,093,510 | A | * | 7/2000 | Helber et al. | 430/522 |
| 6,165,706 | A | * | 12/2000 | Fujiwara et al. | 430/522 |
| 6,183,944 | B1 | * | 2/2001 | Helber et al. | 430/517 |
| 6,214,499 | B1 | * | 4/2001 | Helber et al. | 430/522 |
| 6,465,163 | B2 | * | 10/2002 | Sakurada et al. | 430/619 |

* cited by examiner

*Primary Examiner*—Richard L. Schilling
(74) *Attorney, Agent, or Firm*—Birch, Stewart, Kolasch & Birch, LLP

(57) ABSTRACT

Disclosed is a photothermographic material having a support, at least one photosensitive layer containing a silver halide and a reducing agent and a non-photosensitive layer containing aggregates of a dye, wherein a transmission absorption spectrum of the aggregates has a maximum absorption wavelength within the range of 600–750 nm. The photothermographic material is easy to handle and provide an image having sufficient definition without residual color after development. The photothermographic material is suitable for light exposure with a red laser.

17 Claims, No Drawings

PHOTOTHERMOGRAPHIC MATERIAL

TECHNICAL FIELD

The present invention relates to a photothermographic material, more precisely, a photothermographic material that shows little residual color in the absence of substantial decoloration and provides an image of high definition.

RELATED ART

Photothermographic materials have been proposed since old days and described in, for example, U.S. Pat. Nos. 3,152,904, 3,457,075, and B. Shely, "Thermally Processed Silver Systems" in Imaging Processes and Materials, Neblette, 8th Ed., Ed. by Sturge, V. Walworth and A. Shepp, page 2, 1969. Photothermographic materials generally have a photosensitive layer containing a catalytic amount of photocatalyst (e.g., silver halide), a reducing agent, a reducible silver salt (e.g., silver salt of an organic acid) and a toning agent for controlling silver color tone, which are typically dispersed in a binder matrix. After being exposed imagewise, photothermographic materials are heated at an elevated temperature (e.g., 80° C. or higher) and thereby an oxidation/reduction reaction is caused between the silver halide or the reducible silver salt (functioning as an oxidizing agent) and the reducing agent to form a black silver image. The oxidation/reduction reaction is promoted by the catalytic action of a latent image of silver halide produced by the exposure. Therefore, the black silver image is formed in the exposed area.

Heat development has an advantage of easy and quick processing because it does not require processing solutions as used in the wet development processing. In recent years, simple and quick development processing is desired in the field of photographic techniques, in particular, photography for medical and printing use. Since wet development processing has substantially reached the limit of improvements, image formation methods based on the heat development are noted in the technical fields of, in particular, photography for medical use and printing use.

However, the heat development suffers from various problems that never occur with the wet development.

One of the problems is the problem concerning decoloration of dye. A dye is often added to photographic light-sensitive materials as a filter or for anti-halation or anti-irradiation purpose. A dye is usually added to a non-photosensitive layer and exerts its function upon imagewise exposing. If the dye remains in the photographic light-sensitive material thereafter, the formed image may be colored with the dye. Therefore, the dye is preferably removed from the photographic light-sensitive material during development after the exposure. In the wet development process, the dye can be readily removed from the photographic light-sensitive material with processing solutions. By contrast, it is very difficult (or substantially impossible) to remove the dye in heat development. For light-sensitive materials exposed with near infrared, infrared or red laser rays, in particular, it is necessary to sufficiently prevent irradiation and halation during exposure in order to obtain an image of high definition, and therefore a dye is usually contained in light-sensitive materials to prevent such a phenomenon. However, because it is difficult to remove a dye in heat development, the coloration of image due to the remaining dye particularly causes a problem.

As one class of methods for solving such a problem, there have been proposed methods of decoloring a dye by heating during heat development. For example, U.S. Pat. No. 5,135,842 discloses a method of decoloring a polymethine dye having a particular structure by heating. U.S. Pat. Nos. 5,314,795, 5,324,627 and 5,384,237 disclose methods of decoloring polymethine dyes by using carbanion generators. As another class of methods, Japanese Patent Laid-open Publication (Kokai, henceforth referred to as JP-A) No. 9-146220, JP-A-11-223898 and so forth propose methods of solving the problem by using an invisible dye that has an absorption peak having a narrow half band width in the near infrared region and shows little absorption in the visible region, substantially without providing a decoloration mechanism.

However, there is no effective means for preventing residual color due to a dye with respect to light-sensitive materials exposed with a red laser ray except for use of a complicated decoloration mechanism, and no effective solution has been proposed yet. Therefore, use of the images must be limited, for example, the images are not used as images for appreciation as visible images as described in JP-A-13294, or the images must be changed to those that can be used as images for appreciation as visible images by delaminating the antihalation layer after exposure (even with increase of waste materials). When the coloration with a dye is prevented by utilizing a decoloration mechanism in a light-sensitive material exposed with a red laser ray, mentioned as problems are insufficient decoloration of the dye, decoloration of the dye during storage of photothermographic materials due to insufficient stability of the dye and so forth. For example, when a polymethine dye is used for the purpose of prevention of irradiation etc., the polymethine dye decomposes during heat development after light exposure and decolored to some extent. However, since the decomposition products of the polymethine dye have light-absorbing property to a certain extent, the docoloration becomes insufficient and thus residual color of images (especially in highlight portions) poses a problem. Furthermore, there is also a problem that a dye once decolored may recolor due to contact with an acid or the like. When decoloration of dye is attained by using a complicated reaction mechanism, there is also caused a problem that there should be various by-products in the light-sensitive material due to the complicated reaction mechanism and they degrade handling property of the light-sensitive material after the heat development.

SUMMARY OF THE INVENTION

The present invention was accomplished in view of the aforementioned various problems, and its object is to provide a photothermographic material suitable for light exposure with a red laser ray that can provide an image having sufficient definition without residual color after development and superior handling property.

The inventors of the present invention assiduously studied about dyes and as a result, they obtained a finding that irradiation upon exposure with a red laser ray could be sufficiently prevented by using a dye in an aggregated state showing sharp absorption (having a narrow half band width), and such a dye showed markedly little absorption for lights within the visible region and thus causes no practical problem of remaining color tint. They accomplished the present invention based on this finding.

That is, in order to achieve the aforementioned object, the present invention provides a photothermographic material having a support, at least one photosensitive layer containing a silver halide and a reducing agent and a non-photosensitive layer containing aggregates of a dye, wherein a transmission absorption spectrum of the aggregates has a maximum absorption wavelength within the range of 600–750 nm. The photothermographic material of the present invention preferably further contains a non-photosensitive silver source (more preferably, silver salt of an organic acid). Further, the photothermographic material of the present invention preferably contains the aggregates of a dye in the form of aqueous microparticles containing hydrophilic colloid in the non-photosensitive layer.

As preferred embodiments of the present invention, there are provided the aforementioned photothermographic material, wherein the maximum absorbance peak in the transmission absorption spectrum of the aggregates has a half band width of 100 nm or less; the aforementioned photothermographic material, wherein the aggregates show a maximum absorbance of 0.15 or less for a light having a wavelength of 400–600 nm before and after heat treatment; and the aforementioned photothermographic material, wherein the aggregates show an absorbance of 0.2 or more for a light of a wavelength for light exposure.

As a preferred embodiment of the present invention, there is provided the aforementioned photothermographic material, wherein the photosensitive layer is disposed on a laminate of the non-photosensitive layer and the support, and as a more preferred embodiment of the present invention, there is provided the aforementioned photothermographic material, wherein the photosensitive layer is disposed on the support side of the laminate.

The dye is preferably a polymethine dye (more preferably a cyanine dye or an oxonol dye). The dye is especially preferably a cyanine dye represented by the following formula (I) or an oxonol dye represented by the following formula (II).

Formula (I)

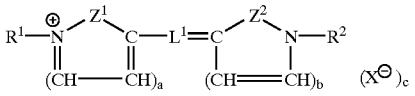

In the formula (I), $Z^1$ and $Z^2$ each independently represent a nonmetallic atom group required to complete a 5- or 6-membered nitrogen-containing heterocyclic ring, $R^1$ and $R^2$ each independently represent an alkyl group, an alkenyl group, an aralkyl group or an aryl group, $L^1$ represents a methine chain consisting of an odd number of methines, and X represents an anion. a, b and c each independently represent 0 or 1.

Formula (II)

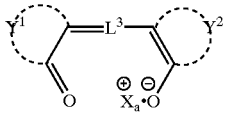

In the formula (II), $Y^1$ and $Y^2$ each independently represent a nonmetallic atom group required to complete an aliphatic ring or a heterocyclic ring, $L^3$ represents a methine chain consisting of an odd number of methines, and Xa represents a proton or a cation.

As preferred embodiments of the present invention, there are provided the aforementioned photothermographic material, which is exposed by using a red laser, and the aforementioned photothermographic material, which is used for forming an image for medical use.

According to the present invention, there can be obtained a photothermographic material that can provide sufficient definition and shows no residual color and superior handling property after development as a photothermographic material for light exposure with a red laser.

BEST MODE FOR CARRYING OUT THE INVENTION

The photothermographic material of the present invention will be explained in detail hereafter. In the following description, ranges indicated with "-" mean ranges including the numerical values before and after "-" as the minimum and maximum values.

The photothermographic material of the present invention has at least one photosensitive layer and at least one non-photosensitive layer, and contains aggregates of a dye in at least one non-photosensitive layer. The aggregates have a maximum absorption wavelength in the range of 600–750 nm, preferably 600–720 nm, more preferably 620–700 nm. Therefore, the maximum absorption wavelength in the transmission absorption spectrum of the photothermographic material of the present invention is preferably in the range of 600–750 nm, more preferably 600–720 nm, further preferably 620–700 nm.

The aggregates show an absorption width at ½ of the maximum absorbance peak (i.e., half band width) of preferably 100 nm or less, more preferably 80 nm or less, further preferably 40 nm or less, particularly preferably 25 nm or less, in the transmission absorption spectrum. It is preferred that the half band width of the photothermographic material of the present invention should also be in a similar range.

The aggregates preferably show a maximum absorbance for a light having a wavelength of 400–600 nm of 0.15 or less, more preferably 0.13 or less, further preferably 0.10 or less, before and after heat treatment. It is preferred that the photothermographic material of the present invention in an unexposed state should show a maximum absorbance for the aforementioned wavelength range in a similar range.

The aggregates preferably show absorbance of 0.2 or more for a light of a wavelength for light exposure. The term "light of a wavelength for light exposure" used herein means a light of a wavelength at which the photothermographic material is exposed, and it means a light of a wavelength in the range of 600–750 nm, preferably 620–700 nm, for the photothermographic material of the present invention. It is preferred that the photothermographic material of the present invention should also show absorbance for a light of a wavelength for light exposure in the aforementioned range.

In the photothermographic material of the present invention, the photosensitive layer is preferably disposed on a laminate of the non-photosensitive layer and the support, and the photosensitive layer is preferably disposed on the support side of the laminate. That is, a structure in which the non-photosensitive layer containing the aggregates, the support and the photosensitive layer are laminated in this order is more preferred.

The dye used for the present invention exists in the state of aggregates in the photothermographic material.

A dye existing as aggregates forms the so-called J-band and shows a sharp absorption spectrum peak. Aggregation and J-band of dyes are described in various references (e.g., Photographic Science and Engineering, Vol. 18, No. 323–335 (1974)). The absorption maximum of a dye in the J-aggregated state shift to the longer wavelength side compared with the dye as a solution (monomer state). Therefore, it can easily determine whether a dye contained in a layer is in the aggregated state or non-aggregated state by measuring the absorption maximum. As for the dye in the aggregated state, the shift of the absorption maximum from that obtained in the monomer state is preferably 30 nm or more, further preferably 40 nm or more, most preferably 45 nm or more.

Among dyes, there are also compounds that form aggregates only by dissolving or dispersing them in water. Therefore, a non-photosensitive layer containing aggregates of a dye may be formed by only applying an aqueous coating solution or dispersion containing the dye on a support. However, dyes generally do not form aggregates in an aqueous solution, but forms aggregates when gelatin or a salt (e.g., potassium chloride, sodium chloride, barium chloride, calcium chloride, ammonium chloride) is added to an aqueous solution of the dyes. Therefore, a non-photosensitive layer containing aggregates of a dye can be formed by applying, on a support, a coating solution or dispersion formed by adding gelatin to an aqueous solution of a dye or adding a dye to an aqueous solution of gelatin. In such an embodiment, the aggregates of a dye are contained in a non-photosensitive layer as aqueous microparticle dispersion containing hydrophilic colloid.

Further, aggregates of a dye can also be formed as a solid microparticle dispersion of the dye. In order to obtain a solid microparticle dispersion state, a known dispersing machine can be used. Examples of such a dispersing machine include ball mill, vibration mill, planetary ball mill, sand mill, colloid mill, jet mill and roller mill. Medium dispersing machines of vertical type or horizontal type (described in JP-A-52-92716 and International Patent Publication WO88/074794) are preferred. Dispersion operation may be performed in the presence of a suitable medium (e.g., water, alcohol). It is preferable to use a surfactant for dispersion. Anionic surfactants (described in JP-A-52-92716 and WO88/074794) are preferably used. If necessary, anionic polymers, nonionic surfactants or cationic surfactants may be used. After dissolving a dye in a suitable solvent, a poor solvent may be added to obtain microparticulate powder. The aforementioned surfactants can also be used in this case. Further, microcrystals of a dye may be deposited by regulating pH of a solution. Such microcrystals are also aggregates of a dye.

In the present invention, two or more kinds of dyes in the aggregated state may be used. In such a case, one kind of aggregated state may be formed with two or more kinds of dyes, or dyes in two or more kinds of aggregated states may be used together.

Although the dye that can form aggregates, which is used for the present invention, is not particularly limited, polymethine dyes are preferred. Polymethine dyes can be classified into cyanine dyes, melocyanine dyes, arylidene dyes, stilyl dyes and oxonol dyes. These polymethine dyes are defined by the following formulas.

Cyanine dye: Bs=Lo-Bo

Melocyanine dye: Bs=Le=Ak

Arylidene dye: Ak=Lo-A

Stilyl dye: Bo-Le-Ar

Oxonol dye: Ak=Lo-Ae

In the formulas, Bs represents a basic nucleus, Bo represents an onium of basic nucleus, Ak represents a keto type acidic nucleus, Ae represents an enol type acidic nucleus, Ar represents an aromatic nucleus, Lo represents a methine chain consisting of an odd number of methines, and Le represents a methine chain consisting of an even number of methines.

In the present invention, it is preferable to use a cyanine dye or an oxonol dye among the polymethine dyes, and it is still preferable to use a cyanine dye. As the cyanine dye, compounds represented by the formula (I) above are preferred.

In the formula (I), $Z^1$ and $Z^2$ each independently represent a nonmetallic atom group required to complete a 5- or 6-membered nitrogen-containing heterocyclic ring. Another heterocyclic ring, aromatic ring or aliphatic ring may condense to the nitrogen-containing heterocyclic ring. Examples of the nitrogen-containing heterocyclic ring and condensed ring thereof include oxazole ring, oxazoline ring, isoxazole ring, benzoxazole ring, naphthoxazole ring, thiazole ring, thiazoline ring, benzothiazole ring, naphthothiazole ring, selenazole ring, selenazoline ring, benzoselenazole ring, indolenine ring, benzoindolenine ring, imidazole ring, imidazoline ring, benzimidazole ring, naphthoimidazole ring, quinoline ring, pyridine ring, pyrrolopyridine ring, furopyrrole ring, indolidine ring, imidazoquinoxaline ring, quinoxaline ring, oxadiazole ring, thiadiazole ring, tetrazole ring and pyrimidine ring. The nitrogen-containing heterocyclic ring is preferably a 5-membered ring, and more preferably, a benzene ring or naphthalene ring is condensed to the 5-membered nitrogen-containing heterocyclic ring. The nitrogen-containing heterocyclic ring is more preferably a benzimidazole ring, naphthoimidazole ring, benzoxazole ring, naphthoxazole ring, benzothiazole ring or naphthothiazole ring, particularly preferably a benzothiazole ring or naphthothiazole ring.

The nitrogen-containing heterocyclic ring and the ring condensed thereto may have a substituent. Examples of the substituent include an alkyl group, a cycloalkyl group, an aralkyl group, an alkoxy group, an aryl group, an aryloxy group, a halogen atom (Cl, Br, F), an alkoxycarbonyl group, an alkylthio group, an arylthio group, an acyl group, an acyloxy group, an amino group, a substituted amino group, an amido group, a sulfonamido group, a ureido group, a substituted ureido group, a carbamoyl group, a substituted carbamoyl group, a sulfamoyl group, a substituted sulfamoyl group, an alkylsulfonyl group, an arylsulfonyl group, a hydroxyl group, a cyano group, a nitro group, a sulfo group, a carboxyl group and a heterocyclic group. The sulfo group and carboxyl group may be in the form of a salt.

The alkyl group may be linear or branched. The alkyl group preferably has 1–20 carbon atoms. The alkyl group may further have a substituent, and examples of the substituent include a halogen atom (Cl, Br, F), an alkoxy group (e.g., methoxy group, ethoxy group), a hydroxyl group and a cyano group. Examples of the alkyl group (including a substituted alkyl group) include methyl group, ethyl group, propyl group, t-butyl group, hydroxyethyl group, methoxyethyl group, cyanoethyl group and trifluoromethyl group. Examples of the cycloalkyl group include cyclopentyl group and cyclohexyl group. The aralkyl group preferably has 7–20 carbon atoms. Examples of the aralkyl group include benzyl group and 2-phenethyl group. The alkoxy group may be branched or linear, and preferably has 1–12 carbon atoms. The alkoxy group may further have a substituent, and examples of the substituent include an alkoxy group and a hydroxyl group. Examples of the alkoxy group (including a substituted alkoxy group) include methoxy group, ethoxy group, methoxyethoxy group and hydroxyethoxy group.

The aryl group is preferably a phenyl group. The aryl group may further have a substituent, and examples of the substituent include an alkyl group, an alkoxy group, a halogen atom and a nitro group. Examples of the substituted aryl group include p-tolyl group, p-methoxyphenyl group, o-chlorophenyl group and m-nitrophenyl group. The aryloxy group is preferably phenoxy group. The aryloxy group may have a substituent, and examples of the substituent include an alkyl group, an alkoxy group and a halogen atom. Examples of the substituted aryloxy group include p-chlorophenoxy group, p-methylphenoxy group and o-methoxyphenyl group. The alkoxycarbonyl group preferably has 2–20 carbon atoms. Examples of the alkoxycarbonyl group include methoxycarbonyl group and ethoxycarbonyl group.

The alkylthio group preferably has 1–12 carbon atoms. Examples of the alkylthio group include methylthio group, ethylthio group and butylthio group. The arylthio group is preferably phenylthio group. The arylthio group may further have a substituent, and examples of the substituent include an alkyl group, an alkoxy group and a carboxyl group. Examples of the substituted arylthio group include p-methylphenylthio group, p-methoxyphenylthio group and o-carboxyphenylthio group. The acyl group preferably has 2–20 carbon atoms. Examples of the acyl group include acetyl group and butyroyl group. The acyloxy group preferably has 2–20 carbon atoms. Examples of the acyloxy group include acetoxy group and butyryloxy group. The substituted amino group preferably has 1–20carbon atoms. Examples of the substituted amino group include methylamino group, anilino group, and triazinylamino group. The amido group preferably has 2–20 carbon atoms. Examples of the amido group include acetamido group, propionamido group and isobutanamido group. The sulfonamido group preferably has 1–20 carbon atoms. Examples of the sulfonamido group include methanesulfonamido group and benzenesulfonamido group.

The substituted ureido group preferably has 2–20 carbon atoms. Examples of the substituted ureido group include 3-methylureido group and 3,3-dimethylureido group. The substituted carbamoyl group preferably has 2–20 carbon atoms. Examples of the substituted carbamoyl group include methylcarbamoyl group and dimethylcarbamoyl group. The substituted sulfamoyl group preferably has 1–20 carbon atoms. Examples of the substituted sulfamoyl group include dimethylsulfamoyl group and diethylsulfamoyl group. The alkylsulfonyl group preferably has 1–20 carbon atoms. Examples of the alkylsulfonyl group include methanesulfonyl group. The arylsulfonyl group is preferably benzenesulfonyl group. Examples of the heterocyclic group include pyridyl group and thienyl group.

In the aforementioned formula (I), $R^1$ and $R^2$ each independently represent an alkyl group, an alkenyl group, an aralkyl group or an aryl group. Especially, an alkyl group is preferred. The alkyl group may be linear or branched. The alkyl group preferably has 1–20 carbon atoms. The alkyl group may have a substituent, and examples of the substituent include a halogen atom (Cl, Br, F), an alkoxycarbonyl group (e.g., methoxycarbonyl group, ethoxycarbonyl group), a hydroxyl group, a sulfo group and a carboxyl group. The sulfo group and carboxyl group may be in the form of a salt. The alkenyl group may be linear or branched. The alkenyl group preferably has 2–10 carbon atoms. Examples of the alkenyl group include 2-pentenyl group, vinyl group, allyl group, 2-butenyl group and 1-propenyl group. The alkenyl group may have a substituent, and examples of the substituent are similar to the examples of the substituent of the aforementioned alkyl group.

The aralkyl group preferably has 7–12 carbon atoms. Examples of the aralkyl group include benzyl group and phenethyl group. The aralkyl group may have a substituent, and examples of the substituent include an alkyl group (e.g., methyl group, ethyl group, propyl group), an alkoxy group (e.g., methoxy group, ethoxy group), an aryloxy group (e.g., phenoxy group, p-chlorophenoxy group), a halogen atom (Cl, Br, F), an alkoxycarbonyl group (e.g., ethoxycarbonyl group), a halocarbon group (e.g., trifluoromethyl group), an alkylthio group (e.g., methylthio group, ethylthio group, butylthio group), an arylthio group (e.g., phenylthio group, o-carboxylphenylthio group), a cyano group, a nitro group, an amino group, an alkylamino group (e.g., methylamino group, ethylamino group), an amido group (e.g., acetamido group, propionamido group), an acyloxy group (e.g., acetoxy group, butyryloxy group), a hydroxyl group, a sulfo group and a carboxyl group. The sulfo group and carboxyl group may be in the form of a salt. Examples of the aryl group include phenyl group and naphthyl group. The aryl group may have a substituent, and examples of the substituent are similar to the examples of the substituent of the aforementioned aralkyl group.

In the aforementioned formula (I), $L^1$ represents a methine chain consisting of an odd number of methines. The number of methines is preferably 1, 3, 5 or 7, more preferably 3 or 5, particularly preferably 3. The methine chain represented by $L^1$ may have a substituent. The methine having a substituent is preferably the methine at the center (meso position) of the methine chain. Examples of the substituent include an alkyl group, an alkoxy group, an aryloxy group, a halogen atom, an alkoxycarbonyl group, a halocarbon group, an alkylthio group, an arylthio group, a cyano group, a nitro group, an amino group, an alkylamino group, an amido group, an acyloxy group, a hydroxyl group, a sulfo group and a carboxyl group. Two of substituents may bond to form a 5-membered or 6-membered ring.

In the aforementioned formula (I), X represents an anion. Examples of the anion include a halide ion ($Cl^-$, $Br^-$, $I^-$), p-toluenesulfonate ion, ethylsulfate ion, $PF^{6-}$, $BF^{4-}$ and $ClO^{4-}$. In the aforementioned formula (I), a, b and c each independently represent 0 or 1. a and b preferably represent 0. When the cyanine dye has an anionic substituent such as a sulfo group or a carboxyl group and forms an intramolecular salt, c is 0.

As the oxonol dye, compounds represented by the formula (II) above are preferred.

In the aforementioned formula (II), $Y^1$ and $Y^2$ each independently represent a nonmetallic atom group required to complete an aliphatic ring or a heterocyclic ring. The ring completed with $Y^1$ or $Y^2$ is preferably a heterocyclic ring. Examples of the aliphatic ring include indanedione ring. Example of the heterocyclic ring include 5-pyrazolone ring, oxazolone ring, barbituric acid ring, pyridone ring, rhodanine ring, pyrazolidinedione ring and pyrazolopyridone ring. The aliphatic ring and heterocyclic ring may have a substituent, and examples of the substituent are similar to the examples of the substituent of the nitrogen-containing heterocyclic ring completed with $Z^1$ or $Z^2$ in the aforementioned formula (I).

In the aforementioned formula (II), $L^3$ represents a methine chain consisting of an odd number of methines. The number of methines is preferably 3, 5 or 7, more preferably 3 or 5, particularly preferably 3. The methine chain may have a substituent. The methine having a substituent is preferably the methine at the center (meso position) of the methine chain. Examples of the substituent are similar to the examples of the substituent of $L^1$ in the aforementioned formula (I). Two of substituents may bond to form a 5- or 6-membered ring. However, the methine chain is preferably unsubstituted.

In the aforementioned formula (II), Xa represents a proton or a cation. When Xa is a proton, an oxygen atom adjacent to the proton forms a hydroxyl group. Examples of the cation include an alkali metal ion (e.g., sodium ion, potassium ion), ammonium ion, triethylammonium ion, tributylammonium ion, pyridinium ion, tetrabutyl ammonium ion and onium ion.

Specific examples of the polymethine dyes preferably used are shown below. However, the dye used for the present invention is not limited to the following specific examples. In the following specific examples, Ph represents a phenyl group.

(1)-(10)

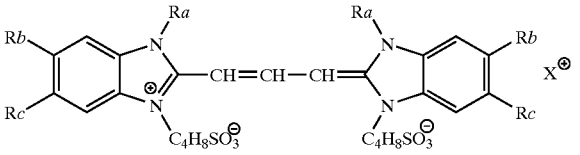

Exemplary Compounds (1) Ra: —$CH_3$, Rb: —Cl, Rc: —Cl, X: Na (2) Ra: —$CH_3$, Rb: —Cl, Rc: —$CF_3$, X: K (3) Ra: —$CH_3$, Rb: —H, Rc: —Cl, X: K (4) Ra: —$CH_3$, Rb: —H, Rc: —$CONH_2$, X: Na (5) Ra: —$C_2H_5$, Rb: —Cl, Rc: —Cl, X: Na (6) Ra: -n-$C_3H_7$ Rb: —Cl, Rc: —Cl, X: Na (7) Ra: —$C_2H_4OC_2H_5$, Rb: —Cl, Rc: —Cl, X: Na (8) Ra: —$C_2H_4OH$, Rb: —Cl, Rc: —Cl, X: Na (9) Ra: —$CH_2$—Ph, Rb: —Cl, Rc: —Cl, X: K

(10) Ra: —Ph, Rb: —Cl, Rc: —Cl, X: K (11)-(15)

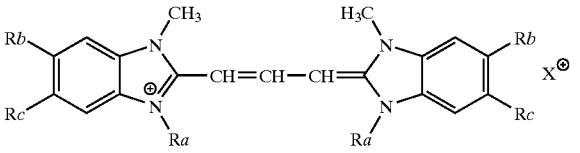

Exemplary Compounds

(11) Ra: —$C_2H_4SO_3^-$, Rb: —Cl, Rc: —Cl, X: K

(12) Ra: —$C_3H_6SO_3^-$, Rb: —Cl, Rc: —$CF_3$, X: Na

(13) Ra: —$CH_2CH_2CH(CH_3)SO_3^-$, Rb: —H, Rc: —CN, X: Na

(14) Ra: —$C_2H_4SO_3^-$, Rb: —H, Rc: —CN, X: $(C_2H_5)_3HN$

(15) Ra: —$C_4H_8SO_3^-$, Rb: —H, Rc: —CN, X: K

-continued (16)

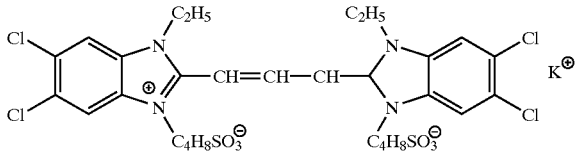

(17)

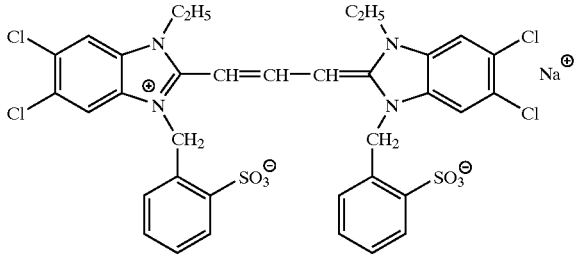

(18)

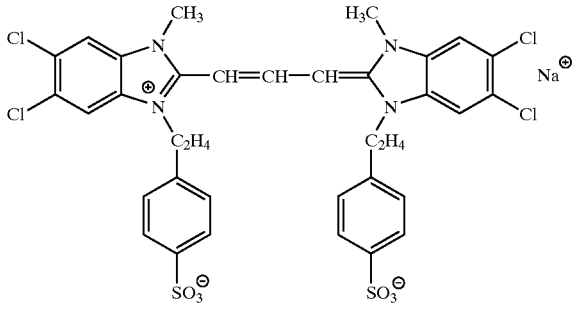

(19)-(29)

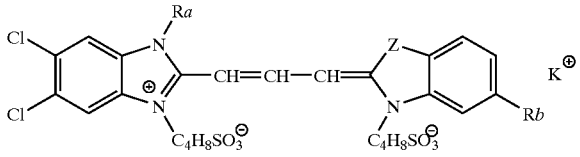

Exemplary Compounds

(19) Ra: —$CH^3$, Rb: —Ph, Z: —S—

(20) Ra: —$C_2H_5$, Rb: —Ph, Z: —S—

(21) Ra: —$C_2H_4OCH_3$, Rb: —Ph, Z: —S—

(22) Ra: —Ph, Rb: —Ph, Z: —S—

(23) Ra: —$CH_2Ph$, Rb: —Ph, Z: —S—

(24) Ra: —$CH_3$, Rb: —Cl, Z: —S—

(25) Ra: —$CH_3$, Rb: —Cl, Z: —O—

(26) Ra: —$C_2H_5$, Rb: —Ph, Z: —O—

(27) Ra: —$C_2H_5$, Rb: —Cl, Z: —Se—

(28) Ra: —$C_2H_5$, Rb: —Cl, Z: —$C(CH_3)_2$—

(29) Ra: —$CH_3$, Rb: —Ph, Z: —Se—

-continued (30)-(33)

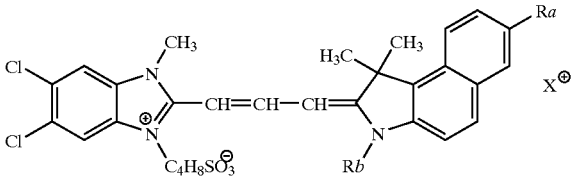

Exemplary Compounds

(30) Ra: —H, Rb: —$C_3H_6SO_3^-$, X: $(C_2H_5)_3HN$

(31) Ra: —$SO_3^-$, Rb: —$C_3H_6SO_3^-$, X: 2K

(32) Ra: —$SO_3^-$, Rb: —$C_3H_6SO_3^-$, X: 2Na

(33) Ra: —$SO_3^-$, Rb: —$CH_2CH_2CH(CH_3)SO_3^-$, X: 2K (34)-(41)

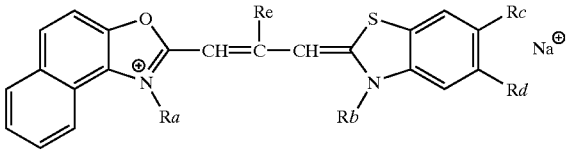

Exemplary Compounds

(34) Ra: —$C_3H_6SO_3^-$, Rb: —$C_3H_6SO_3^-$, Rc: —H, Rd: —Cl, Re: —$C_2H_5$

(35) Ra: —$C_4H_8SO_3^-$, Rb: —$C_4H_8SO_3^-$, Rc: —H, Rd: —Cl, Re: —$C_2H_5$

(36) Ra: —$C_2H_4SO_3^-$, Rb: —$C_4H_8SO_3^-$, Rc: —Cl, Rd: —Cl, Re: —$C_2H_5$

(37) Ra: —$C_2H_4SO_3^-$, Rb: —$C_2H_4SO_3^-$, Rc: —$CH_3$, Rd: —$CH_3$, Re: —$C_2H_5$

(38) Ra: —$C_4H_8SO_3^-$, Rb: —$C_4H_8SO_3^-$, Rc: —$CH_3$, Rd: —$CH_3$, Re: —$C_2H_5$

(39) Ra: —$C_4H_8SO_3^-$, Rb: —$C_3H_6SO_3^-$, Rc: —H, Rd: —Ph, Re: —$C_2H_5$

(40) Ra: —$C_4H_8SO_3^-$, Rb: —$C_4H_8SO_3^-$, Rc: —H, Rd: —$OCH_3$, Re: —$CH_3$

(41) Ra: —$C_4H_8SO_3^-$, Rb: —$C_4H_8SO_3^-$, Rc: —H, Rd: —$OCH_3$, Re: —$CH_3$ (42)-(44)

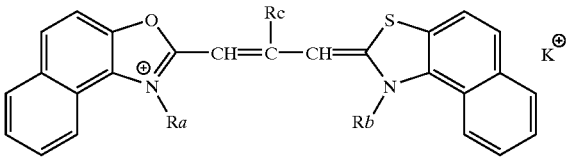

Exemplary Compounds

(42) Ra: —$C_3H_6SO_3^-$, Rb: —$C_3H_6SO_3^-$, Rc: —H,

(43) Ra: —$C_3H_6SO_3^-$, Rb: —$C_3H_6SO_3^-$, Rc: —$CH_3$

(44) Ra: —$C_4H_8SO_3^-$, Rb: —$C_4H_8SO_3^-$, Rc: —$C_2H_5$

-continued (45)-(47)

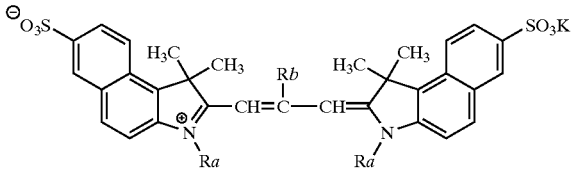

Exemplary Compounds

(45) Ra: —$C_4H_8SO_3K$, Rb: —H

(46) Ra: —$C_4H_8SO_3K$, Rb: —$CH_3$

(47) Ra: —$C_3H_6SO_3K$, Rb: —H (48)-(50)

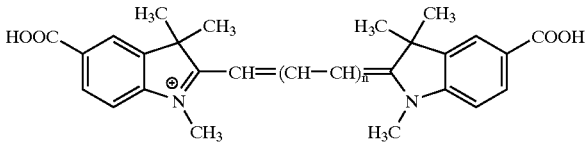

Exemplary Compounds

(48) n: 1

(49) n: 2

(50) n:3

(51)-(55)

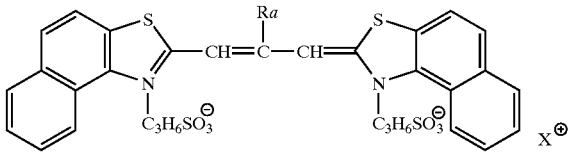

Exemplary Compounds

(51) Ra: —$C_2H_5$, X: $(C_2H_5)_3HN$

(52) Ra: —H, X: $(C_2H_5)_3HN$

(53) Ra: —Ph, X: Na

(54) Ra: —$CH_2Ph$, X: $(C_2H_5)_3HN$

(55) Ra: —$CH_3$, X: $(C_2H_5)_3HN$ (56)-(59)

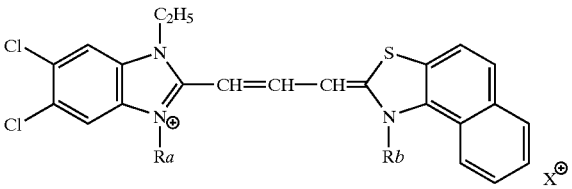

Exemplary Compounds

(56) Ra: —$C_2H_4SO_3^-$, Rb: —$C_3H_6SO_3^-$, X: Na

(57) Ra: —$C_4H_8SO_3^-$, Rb: —$C_4H_8SO_3^-$, X: Na

(58) Ra: —$C_2H_4SO_3^-$, Rb: —$C_2H_4SO_3^-$, X: Na

(59) Ra: —$C_3H_6SO_3^-$, Rb: —$C_3H_6SO_3^-$, X:K

-continued
(60)-(62)
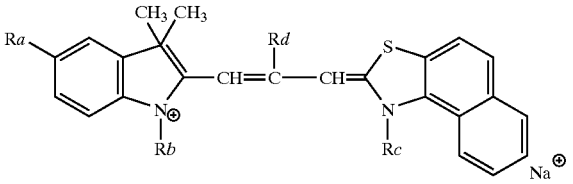
Exemplary Compounds
(60)
Ra: —COOH, Rb: —$C_4H_8SO_3^-$, Rc: —$C_3H_6SO_3^-$, Rd: —$C_2H_5$
(61)
Ra: —COOH, Rb: —$C_4H_8SO_3^-$, Rc: —$C_4H_8SO_3^-$, Rd: —H
(62)
Ra: —H, Rb: —$C_3H_6SO_3^-$, Rc: —$C_3H_6SO_3^-$, Rd: —$CH_3$
(63)
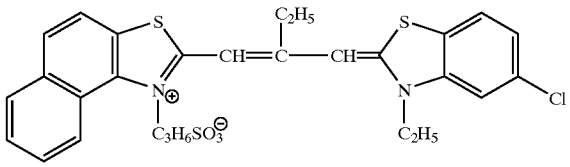
(64)
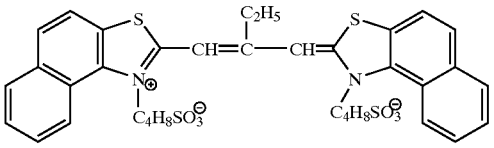
$(C_2H_5)_3HN^{\oplus}$
(65)
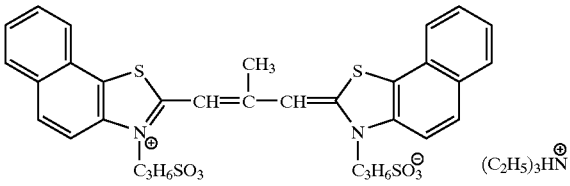
$(C_2H_5)_3HN^{\oplus}$
(66)
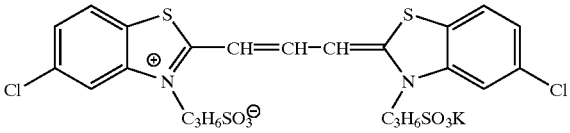
(67)
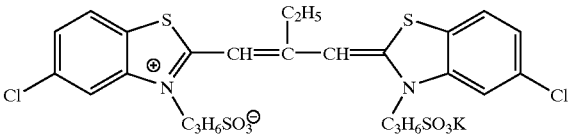
(68)
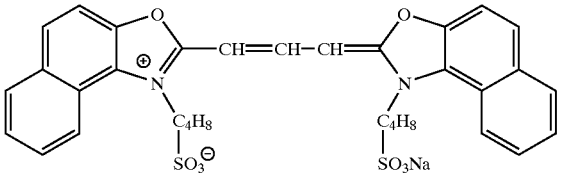
-continued
(69)
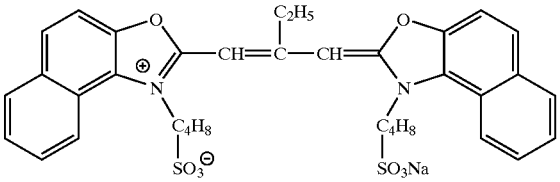
(70)
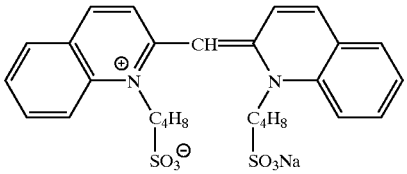
(71)
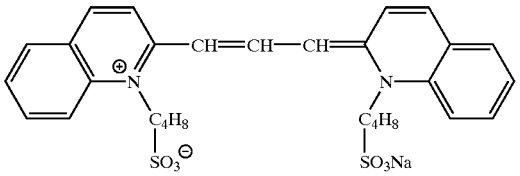
(72)
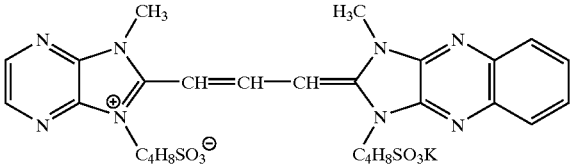
(73)
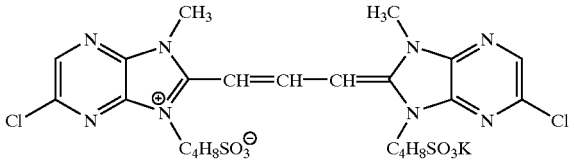
(74)
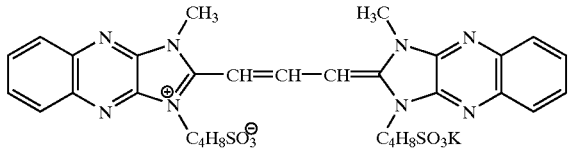
(75-78)
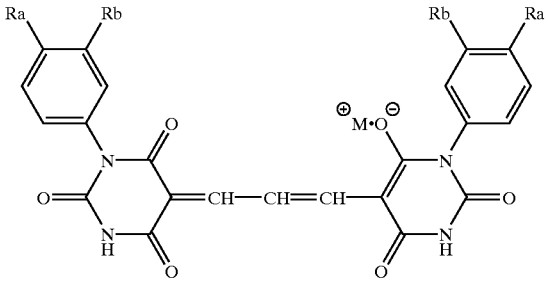
Exemplary Compounds
(75)
Ra: —H, Rb: —H, M: H
(76)
Ra: —H, Rb: —H, M: $(C_2H_5)_3HN$
(77)
Ra: —OH, Rb: —H, M: $(C_2H_5)_3HN$ -continued (78)

Ra: —H, Rb: —OH, M: $(C_2H_5)_3HN$ (79)

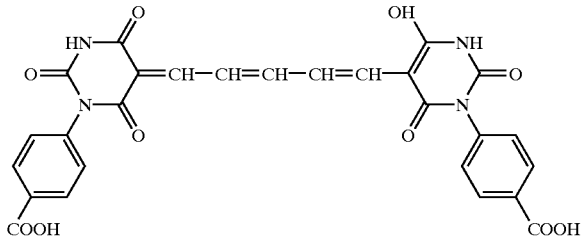

(80)

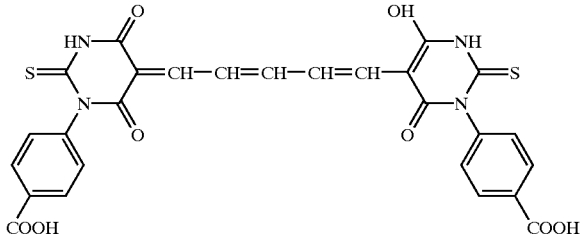

(81)

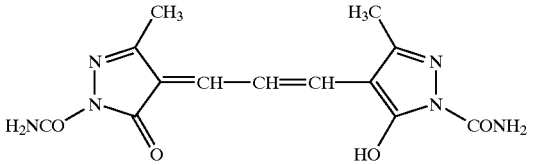

(82)

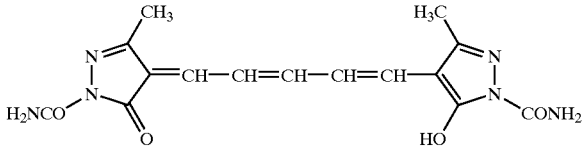

The polymethine dyes can be synthesized by referring to the descriptions of F. M. Harmer, "Heterocyclic Compounds Cyanine Dyes and Related Compounds", John Wiley and Sons, New York, London, 1964 and JP-A-6-313039.

The photothermographic material of the present invention has a photosensitive layer and a non-photosensitive layer. The aforementioned dye should be contained in at least one non-photosensitive layer. As a preferred embodiment of the present invention, there can be mentioned the photothermographic material in which the non-photosensitive layer containing the dye functions as a filter layer or an antihalation layer. Depending on the position of the non-photosensitive layer, it is classified into (1) an overcoat layer provided on a photosensitive layer (the opposite side of the support), (2) an intermediate layer provided between two or more of photosensitive layers, (3) an undercoat layer provided between a photosensitive layer and a support; and (4) a back layer provided on a side opposite to the photosensitive layer. A filter layer is provided in the photosensitive material as the layer of (1) or (2). An antihalation layer is provided in the photothermographic material as the layer of (3) or (4). In the photothermographic material according to a more preferred embodiment of the present invention, the non-photosensitive layer containing the dye is an antihalation layer, i.e., the non-photosensitive layer is disposed as the layer of (3) or (4), and in the photothermographic material according to a further preferred embodiment, the non-photosensitive layer is disposed as the layer of (4).

As a method for adding the dye to a non-photosensitive layer, a method may be employed which comprises a step of adding a solution, emulsion, solid or microparticle dispersion of the dye, or the dye impregnated in a polymer to a coating solution for the non-photosensitive layer. The dye may also be added to the non-photosensitive layer by using a polymer mordant. These addition methods are the same as those generally employed for the addition of dyes to ordinary photothermographic materials. Polymer latex used for preparation of the dye impregnated in a polymer are described in U.S. Pat. No. 4,199,363, German Patent Laid-open Nos. 25,141,274, 2,541,230, EP-A-029104 and Japanese Patent Publication (Kokoku, hereinafter referred to as JP-B) No. 53-41091. An emulsification method by adding a dye to a solution in which a polymer is dissolved is described in International Patent Publication WO88/00723. Content of the dye in the non-photosensitive layer may be determined depending on the intended use. Generally, it is used in such an amount that optical density (absorbance) should exceed 0.1 when it is measured at the wavelength to be used. The optical density is preferably 0.2–2. The amount of the dye used for obtaining such an optical density is generally about 0.001–1 g/m$^2$.

The photothermographic material will be further explained hereafter.

For the photothermographic material of the present invention, a non-photosensitive silver source can be used. Although any silver source can be used so long as it is non-photosensitive and can supply silver (ion), a silver salt of an organic acid is preferably used. The silver salt of an organic acid is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Such non-photosensitive silver salts of an organic acid are disclosed in JP-A-10-62899, paragraphs 0048 to 0049, EP0803763A1, page 18, line 24 to page 19, line 37, EP0962812A1, JP-A-11-349591, JP-A-2000-7683, JP-A-2000-72711 and so forth. Silver salts of an organic acid, in particular, silver salts of a long chained aliphatic carboxylic acid having 10–30, preferably 15–28 carbon atoms, are preferred. Preferred examples of the silver salt of an aliphatic carboxylic acid include silver behenate, silver arachidinate, silver stearate, silver oleate, silver laurate, silver caproate, silver myristate, silver palmitate, mixtures thereof and so forth. In the present invention, there is preferably used silver salt of an organic acid having a silver behenate content of 50 mole % or more, more preferably silver salt of an organic acid having a silver behenate content of 80 mole % or more, further preferably silver salt of an organic acid having a silver behenate content of 90 mole % or more, among the aforementioned silver salts of an organic acid. Further, the non-photosensitive silver source may be contained in either a photosensitive layer or a non-photosensitive layer. When Tg of binder together contained in a layer containing the silver source is 40° C. or higher, the silver behenate content is preferably 55–85 mole %.

The shape of the silver salt of an organic acid that can be used for the present invention is not particularly limited, and acicular grains, rod-like grains, tabular grains and scaly grains can be mentioned. However, scaly silver salt of an organic acid is preferred for the present invention. Grains of irregular shape such as short acicular grains, rectangular parallelepiped grains, cubic grains or potato-like grains having a ratio of long axis and short axis of 5 or less are also preferably used. These grains of silver salt of an organic acid have a characteristic that they show less fog during heat development compared with long acicular grains having a ratio of long axis and short axis of more than 5. The scaly silver salt of an organic acid is described in detail in JP-A-11-349325. As for the scaly silver salt of an organic acid, if the shape of the organic acid silver salt grain is approximated a rectangular parallelepiped and the sides of the rectangular parallelepiped are defined as a, b and c from the shortest, a can be regarded as a thickness of a tabular grain having a plane having sides of b and c as a main plane. The average of a is preferably 0.01–0.23 $\mu$m, more preferably 0.1–0.20 $\mu$m. The average of c/b is preferably 1–6, more preferably 1.05–4, even more preferably 1.1–3, particularly preferably 1.1–2.

The grain size distribution of the aliphatic acid silver salt is preferably monodispersed. The term "monodispersed" as used herein means that the percentage of the value obtained by dividing the standard deviation of the length of the short axis or long axis by the length of the short axis or long axis, respectively, is preferably 100% or less, more preferably 80% or less, further preferably 50% or less. The shape of the aliphatic acid silver salt can be determined from a transmission electron microscope image of aliphatic acid silver salt dispersion. Another method for determining the monodispesibility is a method involving obtaining the standard deviation of a volume weight average diameter of the aliphatic acid silver salt. The percentage (coefficient of variation) of the value obtained by dividing the standard deviation by the volume weight average diameter is preferably 100% or less, more preferably 80% or less, further preferably 50% or less. As a measurement method, for example, the grain size (volume weight average diameter) can be determined by irradiating aliphatic acid silver salt dispersed in a solution with a laser ray and determining an autocorrelation function of the fluctuation of the scattered light on the basis of the change in time.

Methods for production and dispersion of the silver salt of an organic acid used for the present invention are not particularly limited, and various known methods can be used. For example, one can refer to the methods described in the aforementioned JP-A-10-62899, EP0803763A1, EP0962812A1, JP-A-11-349591, JP-A-2000-7683, JP-A-2000-72711, Japanese Patent Application Nos. 11-348228 to 11-348230, 11-203413, 2000-90093, 2000-195621, 2000-191226, 2000-213813, 2000-214155, 2000-191226 and so forth.

In the present invention, although the silver salt of an organic acid can be used in a desired amount, the amount in terms of silver is preferably 0.1–5 g/m$^2$, more preferably 0.3–3 g/m$^2$, further preferably 0.5–2 g/m$^2$.

The photothermographic material of the present invention preferably contains a reducing agent for the non-photosensitive silver source (preferably silver salt of an organic acid). When a silver salt of an organic acid is used as the non-photosensitive silver source, the reducing agent may be any substance (preferably, organic substance) capable of reducing silver ions into metal silver. Examples of the reducing agent are described in JP-A-11-65021, paragraphs 0043 to 0045, EP0803764A1, from page 7, line 34 to page 18, line 12. In the present invention, preferably used as the reducing agent are the so-called hindered phenol type reducing agents and bisphenol type reducing agents, which have a substituent at the ortho-position of phenolic hydroxyl group, and it is more preferable to use a compound represented by the following formula (R).

Formula (R)

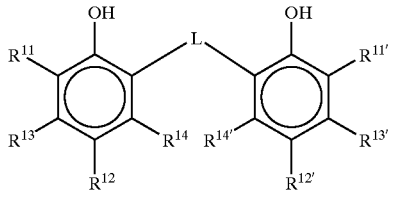

In the aforementioned formula (R), $R^{11}$ and $R^{11'}$ each independently represent an alkyl group having 1–20 carbon atoms. $R^{12}$, $R^{12'}$, $R^{13}$, $R^{13'}$, $R^{14}$ and $R^{14'}$ each independency represent a hydrogen atom or a substituent that can substitute on a benzene ring. L represents a —S— group or a —CHR$^{15}$— group. $R^{15}$ represents a hydrogen atom or an alkyl group having 1–20 carbon atoms.

The formula (R) will be explained in detail.

$R^{11}$ and $R^{11'}$ each independently represent a substituted or unsubstituted alkyl group having 1–20 carbon atoms. Although the substituent of the alkyl group is not particularly limited, preferred examples thereof include an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a ureido group, a urethane group, a halogen atom and so forth. The alkyl group may be linear or branched, and it may also be a cyclic cycloalkyl group.

$R^{12}$, $R^{12'}$, $R^{13}$, $R^{13'}$, $R^{14}$ and $R^{14'}$ each independency represent a hydrogen atom or a substituent that can substitute on a benzene ring. Preferred examples of the substituent that can substitute on a benzene ring include an alkyl group, an aryl group, a halogen atom, an alkoxy group and an acylamino group.

L represents a —S— group or a —CHR$^{15}$— group. $R^{15}$ represents a hydrogen atom or an alkyl group having 1–20 carbon atoms, and the alkyl group may have a substituent. Examples of the unsubstituted alkyl group represented by $R^{15}$ include methyl group, ethyl group, propyl group, butyl group, heptyl group, undecyl group, isopropyl group, 1-ethylpentyl group, 2,4,4-trimethylpentyl group and so forth. Examples of the substituent of the alkyl group are similar to the examples of the substituent of $R^{11}$ and $R^{11'}$.

$R^{11}$ and $R^{11'}$ preferably represent a secondary or tertiary alkyl group having 3–15 carbon atoms, and specific examples thereof include isopropyl group, isobutyl group, t-butyl group, t-amyl group, t-octyl group, cyclohexyl group, cyclopentyl group, 1-methylcyclohexyl group, 1-methylcyclopropyl group and so forth. $R^{11}$ and $R^{11'}$ more preferably represent a tertiary alkyl group having 4–12 carbon atoms, further preferably t-butyl group, t-amyl group or 1-methylcyclohexyl group, most preferably t-butyl group.

$R^{12}$ and $R^{12'}$ preferably represents an alkyl group having 1–20 carbon atoms, and specific examples thereof include methyl group, ethyl group, propyl group, butyl group, isopropyl group, t-butyl group, t-amyl group, cyclohexyl group, 1-methylcyclohexyl group, benzyl group, methoxymethyl group, methoxyethyl group and so forth. $R^{12}$ and $R^{12'}$ more preferably represents methyl group, ethyl group, propyl group, isopropyl group or t-butyl group. $R^{13}$, $R^{13'}$, $R^{14}$ and $R^{14'}$ preferably represent a hydrogen atom, a halogen atom or an alkyl group, more preferably a hydrogen atom.

L is preferably a —CHR$^{15}$— group. $R^{15}$ is preferably a hydrogen atom or an alkyl group having 1–15 carbon atoms, and preferred examples of the alkyl group include methyl group, ethyl group, propyl group, isopropyl group and 2,4,4-trimethylpentyl group. $R^{15}$ is particularly preferably a hydrogen atom, methyl group, ethyl group, propyl group or isopropyl group.

When $R^{15}$ is a hydrogen atom, $R^{12}$ and $R^{12'}$ preferably represents an alkyl group having 2–5 carbon atoms, more preferably ethyl group or propyl group, most preferably ethyl group. When $R^{15}$ is a primary or secondary alkyl group having 1–8 carbon atoms, $R^{12}$ and $R^{12'}$ preferably represents methyl group. The primary or secondary alkyl group having 1–8 carbon atoms represented by $R^{15}$ is preferably methyl group, ethyl group, propyl group or isopropyl group, further preferably methyl group, ethyl group or propyl group.

When $R^{11}$, $R^{11'}$, $R^{12}$ and $R^{12'}$ all represent methyl group, $R^{15}$ preferably represents a secondary alkyl group. In this case, the secondary alkyl group represented by $R^{15}$ is preferably isopropyl group, isobutyl group or 1-ethylpentyl group, more preferably isopropyl group.

The reducing agent represented by the aforementioned formula (R) shows different heat development characteristic, developed silver color tone and so forth depending on a combination of substituents including $R^{11}$, $R^{11'}$, $R^{12}$, $R^{12'}$, $R^{15}$ etc. It is also possible to obtain desired heat development characteristic or developed silver color tone by using two or more kinds of reducing agents in combination.

Specific examples of the reducing agent of the present invention including the compounds represented by the aforementioned formula (R) are shown below. However, the present invention is not limited to these.

(R-1)

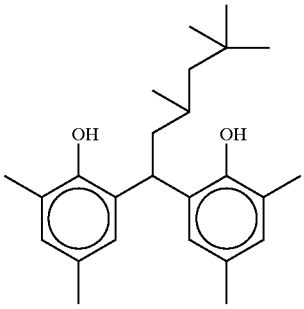

(R-2)

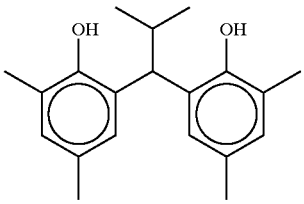

-continued (R-3)

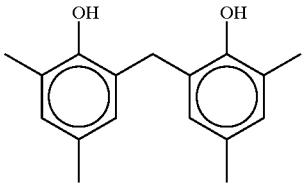

(R-4)

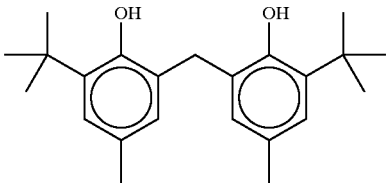

(R-5)

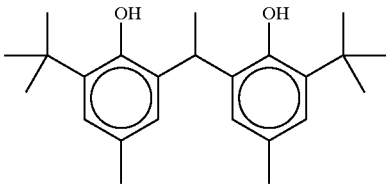

(R-6)

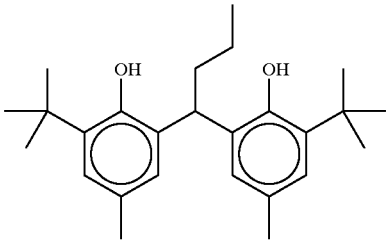

(R-7)

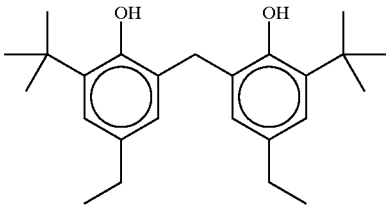

(R-8)

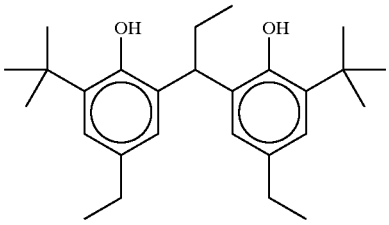

(R-9)

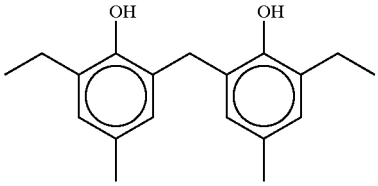

-continued
(R-10)
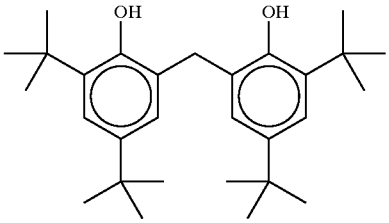
(R-11)
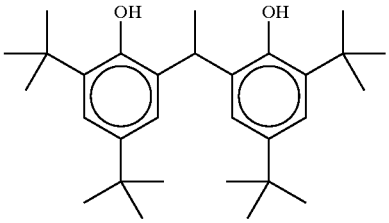
(R-12)
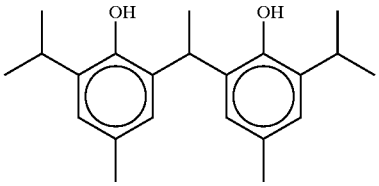
(R-13)
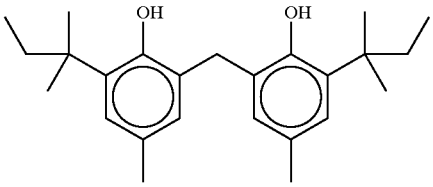
(R-14)
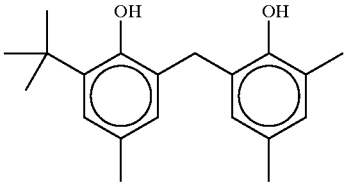
(R-15)
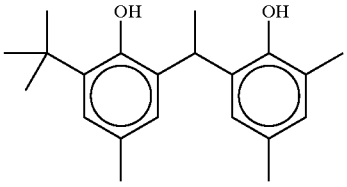
(R-16)
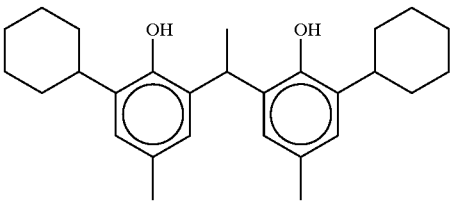
-continued
(R-17)
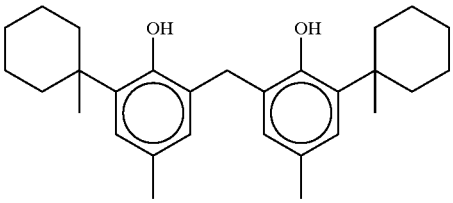
(R-18)
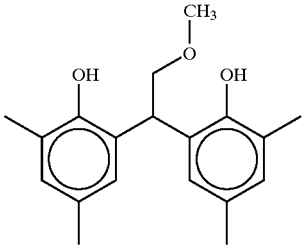
(R-19)
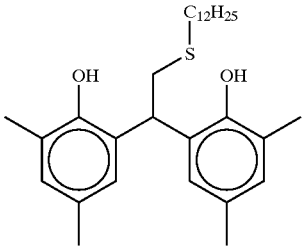
(R-20)
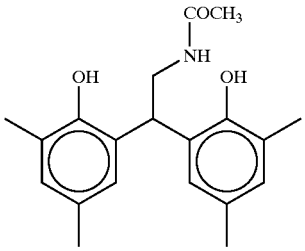
(R-21)
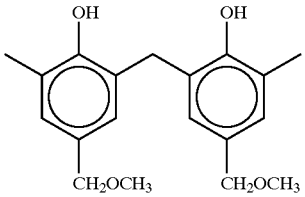
(R-22)
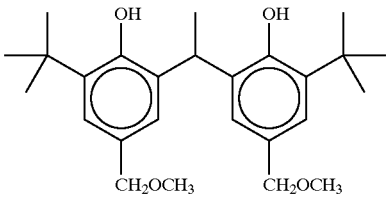

-continued
(R-23)
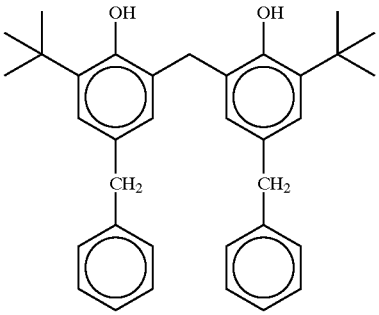
(R-24)
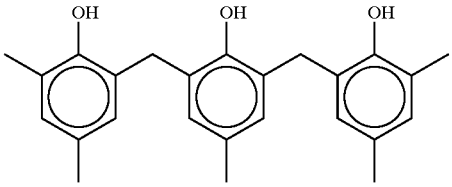
(R-25)
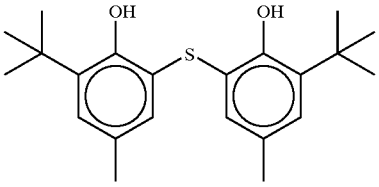
(R-26)
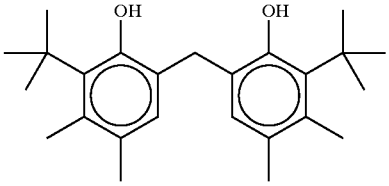
(R-27)
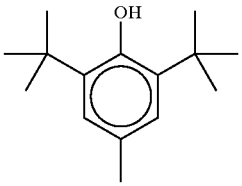
(R-28)
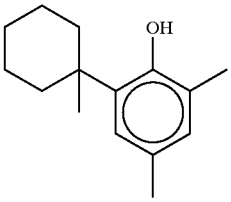
-continued
(R-29)
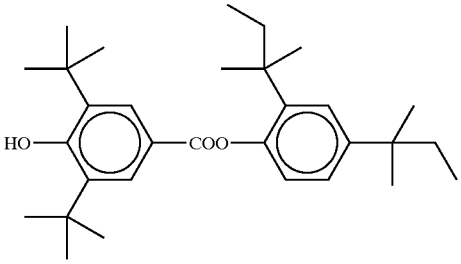
(R-30)
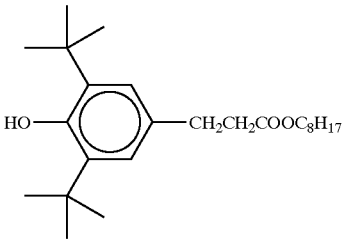
(R-31)
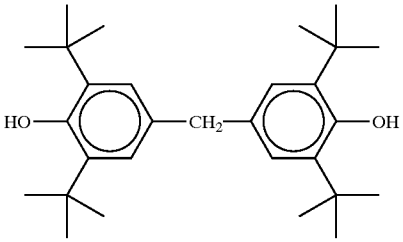
(R-32)
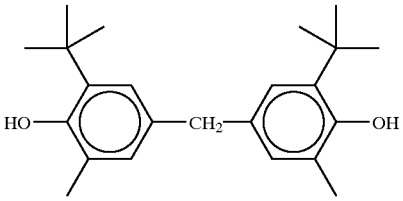
(R-33)
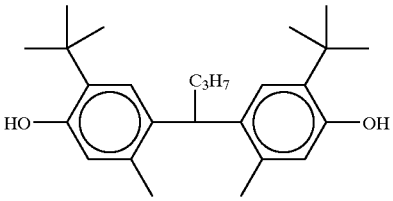
(R-34)
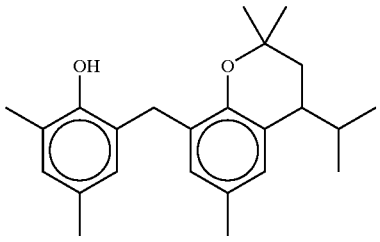

In the present invention, the amount of the reducing agent is preferably 0.1–3.0 g/m$^2$, more preferably 0.2–1.5 g/m$^2$, further preferably 0.3–1.0 g/m$^2$. The amount of the reducing agent is preferably 5–50 mole %, more preferably 8–30 mole %, further preferably 10–20 mole %, per mole of silver on the side having the image-forming layer. The reducing agent is preferably contained in the image-forming layer containing the non-photosensitive silver source.

The reducing agent may be contained in the photothermographic material by adding it to a coating solution in any form such as solution, emulsion dispersion and solid microparticle dispersion and forming a layer with the coating solution.

For preparing a coating solution by emulsion dispersing the reducing agent, there can be mentioned a method of mechanically preparing an emulsion dispersion by using an oil such as dibutyl phthalate, tricresyl phosphate, glyceryl triacetate and diethyl phthalate and an auxiliary solvent such as ethyl acetate or cyclohexanone. Further, as a method for solid microparticle dispersion, there can be mentioned a method for preparing solid microparticle dispersion by dispersing powder of the reducing agent in a suitable solvent such as water using a ball mill, colloid mill, vibration ball mill, sand mill, jet mill and roller mill, or by means of ultrasonic wave. In this operation, protective colloid (e.g., polyvinyl alcohol), surfactant (e.g., anionic surfactants such as sodium triisopropylnaphthalenesulfonate (mixture of those having three isopropyl groups on different positions)) and so forth may be used. In the aforementioned mills, beads such as zirconia beads are usually used as dispersion media, and Zr or the like eluted from such beads may contaminate the dispersion. Although the concentration of the contaminants depends of the dispersion conditions, it is usually in the range of 1–1000 ppm. Content of Zr of 0.05 g or less per 1 g of silver in the photosensitive material does not cause any practical problem.

An aqueous dispersion preferably contains a preservative (e.g., benzisothiazolinone sodium salt).

In the photothermographic material of the present invention, the sulfonamidophenol compounds represented by the formula (A) mentioned in JP-A-2000-267222 and JP-A-2000-330234, hindered phenol compounds represented by the formula (II) mentioned in JP-A-2001-92075, hydrazine compounds represented by the formula (I) mentioned in JP-A-10-62895 and JP-A-11-15116 or the formula (1) mentioned in Japanese Patent Application No. 2001-074278 and phenol or naphthol compounds represented by the formula (2) mentioned in g Japanese Patent Application No. 2000-76240 are preferably used as a development accelerator. These development accelerators are used in an amount in the range of 0.1–20 mol %, preferably 0.5–10 mol %, more preferably 1–5 mol %, with respect to the reducing agent. Although they can be introduced into the photothermographic material by a method similar to those used for introducing the reducing agent, they are particularly preferably introduced as a solid dispersion or emulsion dispersion. When they are added as an emulsion dispersion, they are preferably added as an emulsion dispersion prepared by emulsion dispersion using a high-boiling point solvent that is solid at an ordinary temperature and a low-boiling point auxiliary solvent or a so-called oilless emulsion dispersion that is not added with a high boiling-point solvent.

In the present invention, when a reducing agent having an aromatic hydroxyl group (—OH) is used, in particular when the reducing agent is any of the aforementioned bisphenols is used, it is preferable to use together a non-reducing compound having a group that can form a hydrogen bond with the aromatic hydroxyl group (henceforth referred to as "hydrogen bond-forming compound"). The hydrogen bond-forming compound is described in detail in EP1096310. In the present invention, it is preferable to use hydrogen bond-forming compounds represented by the following formula (D).

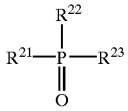

In the formula (D), $R^{21}$, $R^{22}$ and $R^{23}$ each independently represent an alkyl group, an aryl group, an alkoxy group, an aryloxy group, an amino group or a heterocyclic group, and these groups may or may not have one or more substituents. As specific examples of the hydrogen bond-forming compound, besides those mentioned above, those mentioned in EP1096310, Japanese Patent Application Nos. 2000-270498, 2001-124796 and so forth can be mentioned.

Specific examples of the hydrogen bond-forming compounds including those represented by the aforementioned formula (D) will be shown below. However, the present invention is not limited to these examples.

(D-1)

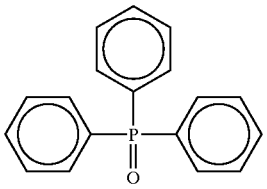

(D-2)

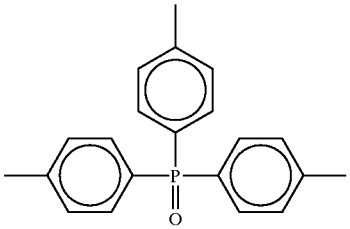

(D-3)

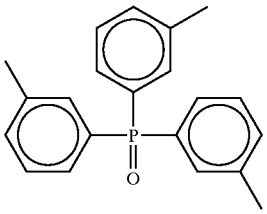

(D-4)

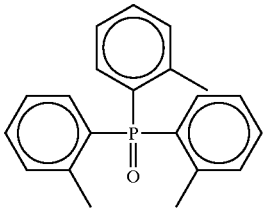

-continued
(D-5)
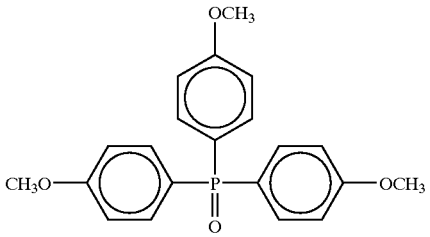
(D-6)
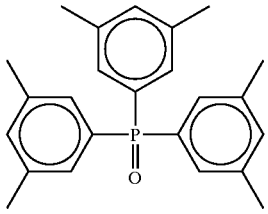
(D-7)
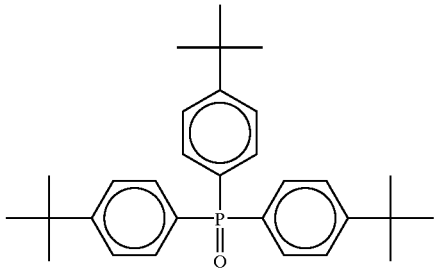
(D-8)
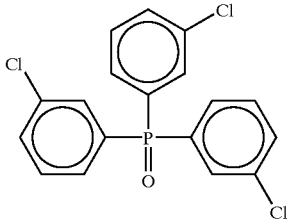
(D-9)
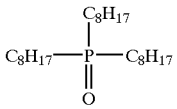
(D-10)
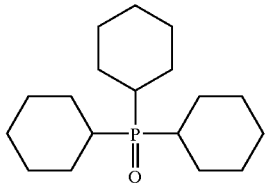
(D-11)
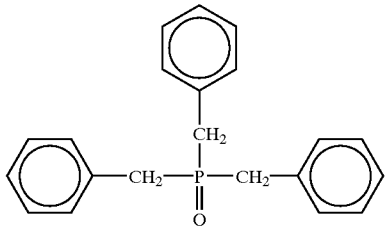
-continued
(D-12)
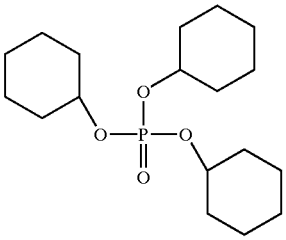
(D-13)
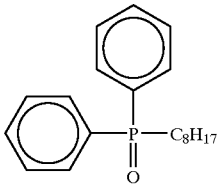
(D-14)
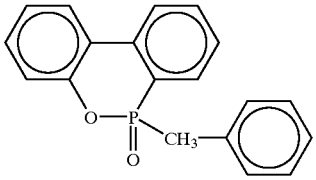
(D-15)
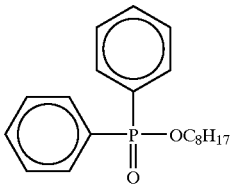
(D-16)
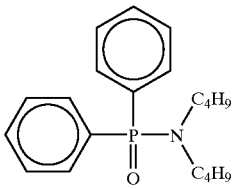
(D-17)
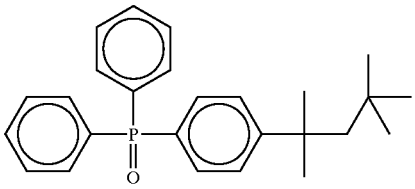
(D-18)
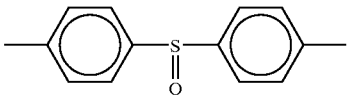
(D-19)
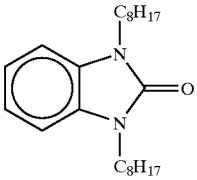

-continued (D-20)

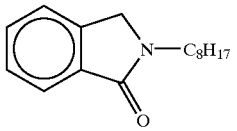

(D-21)

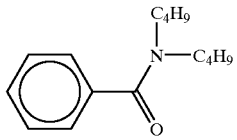

The hydrogen bond-forming compound can be may be added to the photothermographic material by adding it to a coating solution in the form of solution, emulsion dispersion or solid microparticle dispersion and forming a coated layer with the coating solution, like the reducing agent. The hydrogen bond-forming compound (preferably a compound represented by the aforementioned formula (D)) is preferably used in an amount of 1–200 mole %, more preferably 10–150 mole %, further preferably 20–100 mole %, with respect to the reducing agent.

The photothermographic material of the present invention contains silver halide. The silver halide is a photosensitive silver halide. It is not particularly limited as for the halogen composition, and silver chloride, silver chlorobromide, silver bromide, silver iodobromide and silver chloroiodobromide may be used. Among these, silver bromide and silver iodobromide are preferred. The halide composition may have a uniform distribution in the grains, or the compositions may change stepwise or continuously in the grains. Silver halide grains having a core/shell structure may be preferably used. Core/shell grains having preferably a double to quintuple structure, more preferably a double to quadruple structure may be used. A technique for localizing silver bromide on the surface of silver chloride or silver chlorobromide grains may also be preferably used.

Methods for the preparation of the photosensitive silver halide are well known in the art, and there can be used, for example, the methods described in Research Disclosure, No. 17029 (June, 1978) and U.S. Pat. No. 3,700,458. More specifically, a method can be used which comprises preparing photosensitive silver halide grains by addition of a silver-supplying compound and a halogen-supplying compound to a solution of gelatin or other polymer, and then mixing the resulting grains with a silver salt of an organic acid. The methods disclosed in JP-A-119374, paragraphs 0217 to 0224, JP-A-11-352627 (Japanese Patent Application No. 11-98708) and JP-A-2000-347335 are also preferred.

As for a grain size of the photosensitive silver halide, smaller grains are preferred to prevent cloudiness after image formation. Specifically, the grain size may preferably be not greater than 0.20 $\mu$m, more preferably 0.01–0.15 $\mu$m, further preferably 0.02–0.12 $\mu$m. The term "grain size" used herein means a diameter of a circle having the same area of a projected area of the grain (where silver halide grains are tabular grains, projected area of the main plane is used).

Examples of the form of silver halide grains include a cubic form, octahedral form, tabular form, spherical form, rod-like form, potato-like form and so forth. In particular, cubic grains are preferred for the present invention. Silver halide grains having round corners are also preferably used.

Silver halide grains having hexacyano-metal complex on their outermost surfaces are preferably used. Specific examples of the hexacyano-metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$ and so forth. In the present invention, hexacyano-Fe complexes are preferred. The amount of the hexacyano-metal complex is preferably $1\times10^{-5}$ mole to $1\times10^{-2}$ mole, more preferably $1\times10^{-4}$ mole to $1\times10^{-3}$ mole, per mole of silver.

The photosensitive silver halide grains used for the present invention may contain a metal of Group VIII to Group X in the periodic table of elements (including Group I to Group XVIII) or metal complex thereof. The metal of Group VIII to X of the periodic table or the center metal of the metal complex is preferably rhodium, ruthenium or iridium. The metal complex may be used alone, or two or more complexes of the same or different metals may also be used in combination. The content of the metal or metal complex is preferably from $1\times10^{-9}$ to $1\times10^{-3}$ mole per mole of silver. Such heavy metals and metal complexes as well as addition method therefor are described in JP-A-7-225449, JP-A-11-65021, paragraphs 0018 to 0024, and JP-A-11-119374, paragraphs 0227 to 0240.

Further, metal complexes that can be contained in the silver halide grains (e.g., $[Fe(CN)_6]^{4-}$), desalting methods and chemical sensitization methods are described in JP-A-11-84574, paragraphs 0046 to 0050, JP-A-11-65021, paragraphs 0025 to 0031, and JP-A-11-119374, paragraphs 0242 to 0250.

In the present invention, the photosensitive silver halide is contained in a photosensitive layer as a photosensitive silver halide emulsion. For the emulsion, various kinds of gelatin can be used. When the photosensitive silver halide and the silver salt of an organic acid are contained in the same layer, low molecular weight gelatin having a molecular weight of 500–60,000 is preferably used in order to obtain good dispersion state of the photosensitive silver halide emulsion in a coating solution containing a silver salt of an organic acid. While such low molecular weight gelatin may be used during the grain formation or the dispersion operation after the desalting treatment, it is preferably used during the dispersion operation after the desalting treatment.

In the present invention, a sensitizing dye is preferably used in order to spectrally sensitize the silver halide grains in a desired wavelength region. As the sensitizing dye, there can be used those sensitizing dyes which can adsorb on the silver halide grains and have spectral sensitivity suitable for spectral characteristics of the light source to be used for exposure. Such sensitizing dyes and addition methods therefor are described in JP-A-11-65021, paragraphs 0103 to 0109, JP-A-10-18657 as for the compounds represented by the formula (II), JP-A-11-119347 as for the dyes represented by the formula (I) and paragraph 0106, U.S. Pat. Nos. 5,510,236, 3,871,887 as for the dyes disclosed in Example 5, JP-A-2-96131, JP-A-59-48753 as for the dyes disclosed therein and EP 0803764A1, page 19, line 38 to page 20, line 35, Japanese Patent Application Nos. 2000-86865, 2000-102560, 2000-205399 and so forth. These dyes may be used each alone or in any combination of two or more of them. While the amount of the sensitizing dye used in the present invention may be selected to be a desired amount depending on the performance including sensitivity and fog, it is preferably $10^{-6}$ to 1 mole, more preferably $10^{-4}$ to $10^{-1}$ mole, per mole of silver halide in the photosensitive layer.

A supersensitizer can be used in the present invention in order to improve spectral sensitization efficiency. Examples of the supersensitizer used for the present invention include the compounds disclosed in EP587338A, U.S. Pat. Nos. 3,877,943, 4,873,184, JP-A-5-341432, JP-A-11-109547, JP-A-10-111543 and so forth.

Photosensitive silver halide grains are preferably subjected to chemical sensitization by sulfur sensitization, selenium sensitization or tellurium sensitization. Any known compounds can be preferably used for such sulfur, selenium or tellurium sensitization, and for example, the compounds described in JP-A-7-128768 and so forth are usable for that purpose. Tellurium sensitization is particularly preferred for the present invention, and the compounds described in JP-A-11-65021, paragraph 0030 and the compounds of the formulas (II), (III) and (IV) given in JP-A-5-313284 are more preferred.

In the present invention, the chemical sensitization may be performed at any time so long as it is performed after the formation of the grains and before the coating. It may be performed after desalting and (1) before the spectral sensitization, (2) simultaneously with the spectral sensitization, (3) after the spectral sensitization, (4) immediately before the coating, or the like. It is particularly preferably performed after spectral sensitization. In the present invention, the amount of the sulfur, selenium or tellurium sensitizer varies depending on the type of the silver halide grains to be used, conditions for chemical ripening etc., but may fall generally between $10^{-8}$ and $10^{-2}$ mole, preferably between $10^{-7}$ and $10^{-3}$ mole or so, per mole of the silver halide. Although the conditions for the chemical sensitization are not particularly limited, in general, pH is in the range of 5–8, pAg is in the range of 6–11, and temperature is in the range of 40–95° C. The silver halide emulsion used for the present invention may be added with a thiosulfonic acid compound according to the method disclosed in EP293917A.

In the photothermographic material of the present invention, one kind of photosensitive silver halide emulsion may be used or two or more different emulsions (for example, those having different average grain sizes, different halogen compositions, different crystal habits or those subjected chemical sensitization under different conditions) may be used in combination. By using plural photosensitive silver halides having different sensitivities, contrast can be controlled. Examples of the techniques concerning this respect include those mentioned in JP-A-57–119341, JP-A-53-106125, JP-A-47-3929, JP-A-48-55730, JP-A-46-5187, JP-A-50-73627, JP-A-57-150841 and so forth. Each emulsion preferably has sensitivity difference of 0.2 log E or higher for other emulsions.

The amount of the photosensitive silver halide is preferably 0.03–0.6 g/m$^2$, more preferably 0.07–0.4 g/m$^2$, most preferably 0.05–0.3 g/m$^2$, as the amount of coated silver per 1 m$^2$ of the photothermographic material. The amount of the photosensitive silver halide per mole of the silver salt of an organic acid is preferably 0.01–0.5 mole, more preferably 0.02–0.3 mole, further preferably 0.03–0.2 mole.

Methods and conditions for mixing photosensitive silver halide and a silver salt of an organic acid, which are separately prepared, are not particularly limited so long as the effect of the present invention can be attained satisfactorily. Examples thereof include, for example, a method of mixing silver halide grains and a silver salt of an organic acid after completion of respective preparations by using a high-speed stirring machine, ball mill, sand mill, colloid mill, vibrating mill, homogenizer or the like, or a method of preparing a silver salt of an organic acid by mixing a photosensitive silver halide obtained separately at any time during the preparation of the silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

Preferred addition time point for the silver halide into a coating solution for image-forming layer resides in a period of from 180 minutes before the coating to immediately before the coating, preferably 60 minutes to 10 seconds before the coating. However, the method and conditions for mixing are not particularly limited so long as the effect of the present invention can be attained satisfactorily. Specific examples of the mixing method include a method in which the mixing is performed in a tank designed so that a desired average residence time therein can be obtained, which residence time is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

In the present invention, the binder of the layer containing the silver salt of an organic acid may be any polymer. Preferred binders are those that are transparent or translucent, and generally colorless. The binder may consist of, for example, a naturally occurring resin, polymer or copolymer, synthetic resin, polymer or copolymer or other media that can form a film, such as gelatins, rubbers, poly(vinyl alcohols), hydroxyethylcelluloses, cellulose acetates, cellulose acetate butyrates, poly(vinylpyrrolidones), casein, starch, poly(acrylic acids), poly(methyl methacrylates), poly(vinyl chlorides), poly(methacrylic acids), styrene/maleic anhydride copolymers, styrene/acrylonitrile copolymers, styrene/butadiene copolymers, poly(vinyl acetals) (e.g., poly(vinyl formal), poly(vinyl butyral)), poly(esters), poly(urethanes), phenoxy resin, poly(vinylidene chlorides), poly(epoxides), poly(carbonates), poly(vinyl acetates), poly(olefins), cellulose esters and poly(amides). The binder may be formed from water, organic solvent or emulsion by coating it.

In the present invention, the binder that can be used for the layer containing a silver salt of an organic acid preferably has a grass transition temperature (Tg) of 10–80° C. (also referred to as "high Tg binder" hereinafter), more preferably 15–70° C., further preferably 20–65° C.

In the present invention, polymers dispersible in aqueous solvents are particularly preferred. Although examples of systems in the dispersed state include, for example, latex in which fine particles of water-insoluble hydrophilic polymer are dispersed, and a system in which a polymer is dispersed in a molecular state or as micelles, particles dispersed as latex are preferred. Dispersed particles preferably have a mean particle size of around 1–50000 nm, more preferably around 5–1000 nm, further preferably 10–500 nm, particularly preferably 50–200 nm. Particle size distribution of the dispersed particles is not particularly limited, and either those having a broad particle size distribution or those having monodispersed particle size distribution may be used. A method of mixing two or more kinds of dispersion having monodispersed particle distribution and using the mixture is also a preferred method in view of control of physical properties of coating solution.

In the present invention, as preferred examples of the polymer dispersible in an aqueous solvent, hydrophobic polymers such as acrylic polymers, polyesters, rubbers (e.g., SBR resins), polyurethanes, polyvinyl chlorides, polyvinyl acetates, polyvinylidene chlorides, polyolefins and so forth can be used. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000–1,000,000, preferably from 10,000–200,000. Polymers having a too small molecular weight fail to give sufficient mechanical strength of the emulsion layer, and those having a too large molecular weight yield bad film forming property, and both of which are not preferred. Further, crosslinked type polymer latex is particularly preferably used.

Specific examples of the preferred polymer latex are mentioned below. They are expressed with the constituent monomers. The numerals parenthesized indicate the contents in terms of weight %. The molecular weights are number average molecular weights. When multifunctional monomers are used, a crosslinked structure is formed and thus the concept of molecular weight cannot be applied. Therefore, for such a polymer, indication of "crosslinked" is appended and molecular weight is omitted. Tg indicates glass transition temperature.

P-1: Latex of -MMA(70)-EA(27)-MAA(3)-(molecular weight: 37000, Tg: 61° C.)

P-2: Latex of -MMA(70)-2EHA(20)-St(5)-AA(5)-(molecular weight: 40000, Tg: 59° C.)

P-3: Latex of -St(50)-Bu(47)-MMA(3)-(crosslinked, Tg: 17° C.)

P-4: Latex of -St(68)-Bu(29)-AA(3)-(crosslinked, Tg: 17° C.)

P-5: Latex of -St(71)-Bu(26)-AA(3)-(crosslinked, Tg: 24° C.)

P-6: Latex of -St(70)-Bu(27)-IA(3)-(crosslinked)

P-7: Latex of -St(75)-Bu(24)-AA(1)-(crosslinked, Tg: 29° C.)

P-8: Latex of -St(60)-Bu(35)-DVB(3)-MAA(2)-(crosslinked)

P-9: Latex of -St(70)-Bu(25)-DVB(2)-AA(3)-(crosslinked)

P-10: Latex of -VC(50)-MMA(20)-EA(20)-AN(5)-AA(5)-(molecular weight: 80000)

P-11: Latex of -VDC(85)-MMA(5)-EA(5)-MAA(5)-(molecular weight: 67000)

P-12: Latex of -Et(90)-MAA(10)-(molecular weight: 12000)

P-13: Latex of -St(70)-2EHA(27)-AA(3)-(molecular weight: 130000, Tg: 43° C.)

P-14: Latex of -MMA(63)-EA(35)-AA(2)-(molecular weight: 33000, Tg: 47° C.)

P-15: Latex of -St(70.5)-Bu(26.5)-AA(3)-(crosslinked, Tg: 23° C.)

P-16: Latex of -St(69.5)-Bu(28.5)-AA(3)-(crosslinked, Tg: 20.5° C.)

Abbreviations used in the above structures represents following monomers:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are also commercially available, and those mentioned below can be used, for example. Examples of acrylic resins are CEBIAN A-4635, 46583, 4601 (all from Daicel Chemical Industries), Nipol Lx811, 814, 821, 820, 857 (all from Nippon Zeon) etc.; examples of polyester resins are FINETEX ES650, 611, 675, 850 (all from Dai-Nippon Ink & Chemicals), WD-size, WMS (both from Eastman Chemical) etc.; examples of polyurethane resins are HYDRAN AP10, 20, 30, 40 (all from Dai-Nippon Ink & Chemicals) etc.; examples of rubber resins are LACSTAR 7310K, 3307B, 4700H, 7132C (all from Dai-Nippon Ink & Chemicals), Nipol Lx416, 410, 438C, 2507 (all from Nippon Zeon) etc.; examples of polyvinyl chloride resins are G351, G576 (both from Nippon Zeon) etc.; examples of polyvinylidene chloride resins are L502, L513 (both from Asahi Chemical Industry) etc.; examples of polyolefin resins are CHEMIPEARL S120, SA100 (both from Mitsui Petrochemical) etc.

These polymer latexes may be used each alone, or two or more kinds of them may be blended as required.

As the polymer latex used in the present invention, styrene/butadiene copolymer latex is particularly preferred. In the styrene/butadiene copolymer, the weight ratio of styrene monomer units and butadiene monomer units is preferably 40:60 to 95:5. The ratio of the styrene monomer units and the butadiene monomer units preferably account for from 60–99 weight % of the copolymer. The polymer latex preferably contains 1–6 weight %, more preferably 2–5 weight %, of acrylic acid or methacrylic acid with respect to the sum of the styrene and butadiene. Further, polymer latex containing acrylic acid is also preferred.

Examples of styrene/butadiene copolymer latexes preferably used for the present invention include the aforementioned P-3 to P-8and P-15, commercially available products, LACSTAR-3307B, 7132C, Nipol Lx416 and so forth.

The layer containing the non-photosensitive silver source (preferably a silver salt of an organic acid) of the photothermographic material of the present invention may optionally be added with a hydrophilic polymer such as gelatin, polyvinyl alcohol, methylcellulose, hydroxypropylcellulose and carboxymethylcellulose. The amount of the hydrophilic polymer is preferably 30% by weight or less, more preferably 20% by weight or less, of the total binder in the layer containing silver salt of an organic acid.

In the present invention, the layer containing silver salt of an organic acid (i.e., the image-forming layer) is preferably formed by using polymer latex. The amount of the binder in the layer containing a silver salt of an organic acid may be 1/10 to 10/1, more preferably 1/3 to 5/1, further preferably 1/1 to 3/1, as indicated by a weight ratio of total binder/silver salt of an organic acid.

In the photothermographic material of the present invention, the layer containing the silver salt of an organic acid may also serve as a photosensitive layer (an emulsion layer) containing a photosensitive silver halide as a photosensitive silver salt. In that case, the weight ratio of total binder/silver halide may preferably be 400–5, more preferably 200–10.

The total amount of the binder in the image-forming layer of the photothermographic material of the present invention is preferably 0.2–30 g/m$^2$, more preferably 1–15 g/m$^2$, further preferably 2–10 g/m$^2$. The image-forming layer may optionally be added with a crosslinking agent for crosslinking, a surfactant for improving coating property of a coating solution and so forth.

In the present invention, the solvent for the coating solution for the layer containing silver salt of an organic acid (for simplicity, a solvent as well as a dispersion medium are herein referred to as a "solvent") is preferably an aqueous solvent containing at least 30% by weight of water. As components other than water, any water-miscible organic solvents may be used such as, for example, methyl alcohol, ethyl alcohol, isopropyl alcohol, methyl cellosolve, ethyl cellosolve, dimethylformamide, ethyl acetate and so forth. The water content of the solvent for the coating solution is preferably at least 50% by weight, more preferably at least 70% by weight. Preferred examples of the solvent composition, besides water, include water/methyl alcohol=90/10, water/methyl alcohol=70/30, water/methyl alcohol/dimethylformamide=80/15/5, water/methyl alcohol/ethyl cellosolve=80/10/5, water/methyl alcohol/isopropyl alcohol=85/10/5 and so forth (numerals indicate weight %).

As antifoggants, stabilizers and stabilizer precursors that can be used for the present invention, there can be mentioned, for example, those mentioned in JP-A-10-62899, paragraph 0070 and EP0803764A1, from page 20, line 57 to page 21, line 7 as well as the compounds described in JP-A-9-281637, JP-A-9-329864, U.S. Pat. Nos. 6,083,681 and EP1048975. Antifoggants preferably used for the present invention are organic halogenated compounds. Examples thereof include, for example, those disclosed in JP-A-11-65021, paragraphs 0111 to 0112. Particularly preferred are the polyhalogenated compounds represented by the formula (P) mentioned in JP-A-2000-284399, the organic polyhalogenated compounds represented by the formula (II) mentioned in JP-A-10-339934, the organic polyhalogenated compounds described in JP-A-2001-31644 and JP-A-2001-33911.

Organic polyhalogenated compounds preferably used for the present invention will be specifically explained hereafter. In the present invention, it is preferable to use organic polyhalogenated compounds represented by the following formula (H).

$$Q—(Y)_n—C(Z^{11})(Z^{12})—X \qquad \text{Formula (H).}$$

In the aforementioned formula (H), Q represents an alkyl group, an aryl group or a heterocyclic group, Y represents a divalent bridging group, n represents 0 or 1, $Z^{11}$ and $Z^{12}$ represent a halogen atom, and X represents a hydrogen atom or an electron withdrawing group.

In the aforementioned formula (H), Q preferably represents a phenyl group substituted with an electron withdrawing group having a positive value of Hammett's substituent constant sp. As for the Hammett's substituent constant, Journal of Medicinal Chemistry, 1973, Vol. 16, No.11, 1207–1216 and so forth can be referred to. X preferably represents an electron withdrawing group, more preferably a halogen atom; an aliphatic, aryl or heterocyclylsulfonyl group; an aliphatic, aryl or heterocyclylacyl group; an aliphatic, aryl or heterocyclyloxycarbonyl group; a carbamoyl group; or a sulfamoyl group, further preferably a halogen atom. As the halogen atom, a chlorine atom, bromine atom and iodine atom are preferred, a chlorine atom and bromine atom are further preferred, and a bromine atom is particularly preferred. Y preferably represents —C(=O)—, —SO— or —$SO_2$—, more preferably —C(=O)— or —$SO_2$—, particularly preferably —$SO_2$—. n represents 0 or 1, preferably 1.

Specific examples of the organic polyhalogenated compounds represented by the aforementioned formula (H) are shown below. However, the present invention is not limited by the following examples at all.

(H-1)

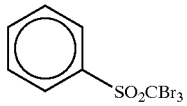

(H-2)

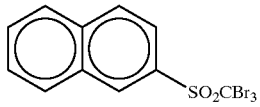

(H-3)

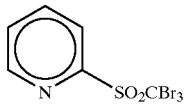

(H-4)

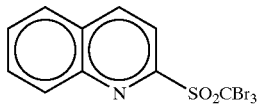

(H-5)

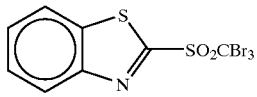

(H-6)

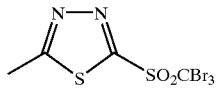

(H-7)

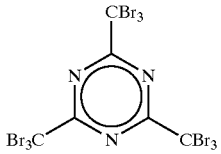

(H-8)

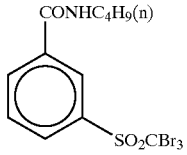

(H-9)

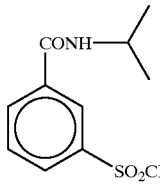

(H-10)

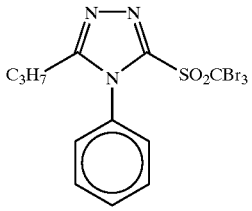

(H-11)

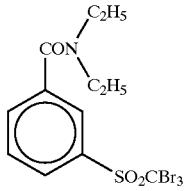

-continued (H-12)

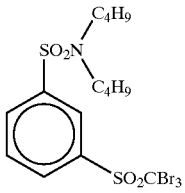

(H-13)

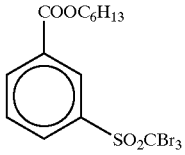

(H-14)

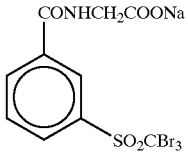

(H-15)

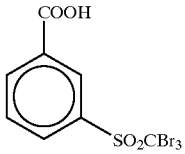

(H-16)

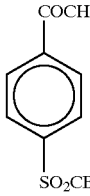

(H-17)

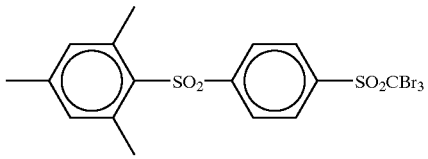

(H-18)

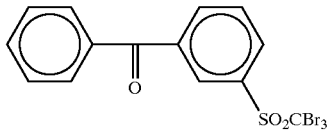

(H-19)

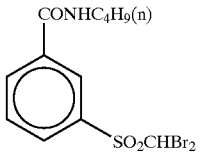

(H-20)

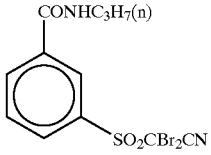

-continued (H-21)

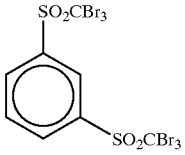

(H-22)

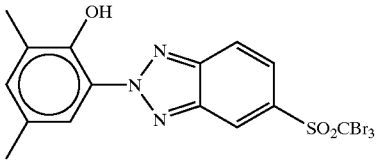

(H-23)

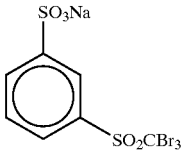

(H-24)

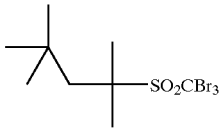

The compound represented by the aforementioned formula (H) is preferably used in an amount of $10^{-4}$ to 1 mole, more preferably $10^{-3}$ to 0.5 mole, further preferably $10^{-2}$ to 0.2 mole, per one mole of the non-photosensitive silver source contained in the image-forming layer.

As the method for introducing an antifoggant into the photothermographic material of the present invention, the aforementioned method for introducing the reducing agent can be mentioned. The organic polyhaogenated compound is also preferably added in the form of solid microparticle dispersion.

Other examples of the antifoggant include the mercury(II) salts described in JP-A-11-65021, paragraph 0113, the benzoic acids described in the same, paragraph 0114, the salicylic acid derivatives described in JP-A-2000-206642, the formalin scavenger compounds represented by the formula (S) mentioned in JP-A-2000-221634, the triazine compounds mentioned in JP-A-11-352624, claim 9, the compounds represented by the formula (III) mentioned in JP-A-6-11791, 4-hydroxy-6-methyl-1,3,3a,7-tetrazaindene and so forth.

The photothermographic material may contain an azolium salt for prevention of fog. Examples of the azolium salt include, for example, the compounds of the formula (XI) disclosed in JP-A-59-193447, the compounds disclosed in JP-B-55-12581 and the compounds of the formula (II) disclosed in JP-A-60-153039.

The photothermographic material of the present invention may optionally contain a mercapto compound, disulfide compound or thione compound to accelerate, suppress or control development, or increase efficiency in spectral sensitivity, or to improve storability before and after development. Examples thereof include, for example, those compounds described in JP-A-10-62899, paragraphs 0067 to 0069, compounds represented by s and specific examples thereof mentioned in JP-A-10-186572, paragraphs 0033 to 0052, and those described in EP0803764A1, page 20, lines 36 to 56. Among them, the mercapto-substituted heteroaromatic compounds described in JP-A-9-297367, JP-A-9-304875, JP-A-2001-100358 and so forth are preferred.

A toning agent is preferably added to the photothermographic material of the present invention. Examples of the toning agent are described in JP-A-10-62899, paragraphs 0054 to 0055, EP0803764A1, page 21, lines 23 to 48 and JP-A-2000-356317 and Japanese Patent Application No. 2000-187298. In particular, preferred are phthalazinones, combinations of phthalazinones and phthalic acids, phthalazines and combinations of phthalazines and phthalic acids, especially combinations of phthalazines and phthalic acids. Particularly preferred among these is a combination of 6-isopropylphthalazine and phthalic acid or 4-methylphthalic acid.

The photosensitive layer of the photothermographic material of the present invention may contain a plasticizer or lubricant. Plasticizers and lubricants are described in JP-A-11-65021, paragraph 0117. Ultrahigh contrast agents for forming ultrahigh contrast images and addition methods and amounts therefor are described in the same publication, paragraph 0118, JP-A-11-223898, paragraphs 0136 to 0193, JP-A-2000-284399, compounds of the formula (H), formulas (1) to (3), formulas (A) and (B) and those mentioned in Japanese Patent Application No. 11-91652 as compounds of the formulas (III) to (V) (specific compounds: Chemical Formulas 21 to 24); and contrast promoters are described in JP-A-11-65021, paragraph 0102, and JP-A-11-223898, paragraphs 0194 to 0195.

When formic acid or a formic acid salt is used as a strongly fogging substance, it is preferably used on the side having the image-forming layer containing a photosensitive silver halide in an amount of 5 mmol or less, more preferably 1 mmol or less, per 1 mole of silver.

When an ultrahigh contrast agent is used in the photothermographic material of the present invention, an acid formed by hydration of diphosphorus pentoxide or a salt thereof is preferably used together with the ultrahigh contrast agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth. The acid formed by hydration of diphosphorus pentoxide or a salt thereof may be used in a desired amount (coating amount per 1 $m^2$ of the photothermographic material) depending on the desired performance including sensitivity and fog. However, it can be used in an amount of preferably 0.1–500 $mg/m^2$, more preferably 0.5–100 $mg/m^2$.

The photothermographic material may be provided with a surface protective layer, for example, to prevent adhesion of dusts to the image-forming layer. The surface protective layer may consist of a single layer or a plurality of layers. The surface protective layer is described in, for example, JP-A-11-65021, paragraphs 0119 to 0120 and Japanese Patent Application No. 2000-171936. While gelatin is preferred as the binder in the surface protective layer, polyvinyl alcohol (PVA) is also preferably used or used together with gelatin. As the gelatin, for example, inert gelatin (e.g., Nitta Gelatin 750), phthalized gelatin (e.g., Nitta Gelatin 801) and so forth can be used. Preferred examples of PVA include, for example, those described in JP-A-2000-171936, paragraphs 0009 to 0020, completely saponified PVA, PVA-105, partially saponified PVA, PVA-205 and PVA-335, denatured polyvinyl alcohol, MP-203 (all from Kuraray Co., Ltd.) and so forth. The application amount of the polyvinyl alcohol (per $m^2$ of the support) for protective layers is preferably 0.3–4.0 $g/m^2$, more preferably 0.3–2.0 $g/m^2$ (per one layer).

When the photothermographic material is used for, in particular, printing use in which dimensional change is critical, polymer latex is preferably used also in a protective layer or a back layer. Such latex is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. Specific example thereof include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer, latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer and so forth. As for the binder of the surface protective layer, there may be used the combination of polymer latex disclosed in Japanese Patent Application No. 11-6872, and techniques disclosed in JP-A-2000-267226 (Japanese Patent Application No. 11–143058), paragraphs 0021–0025, Japanese Patent Application No. 11-6872, paragraphs 0027–0028, and JP-A-2000-19678 (Japanese Patent Application No. 10–199626), paragraphs 0023–0041. The ratio of the polymer latex in the surface protective layer with respect to the total binder is preferably 10–90 weight %, particularly preferably 20–80 weight %.

Coated amount of the total binder (including water-soluble polymer and latex polymer) in the surface protective layer (for one layer) is preferably 0.3–5.0 $g/m^2$, more preferably 0.3–2.0 $g/m^2$ (per $m^2$ of the support).

The temperature for preparation of the coating solution for the image-forming layer of the present invention may preferably be 30–65° C., more preferably 35–60° C., most preferably 35–55° C. The temperature of the coating solution immediately after the addition of the polymer latex may preferably be kept at 30–65° C.

In the present invention, the image-forming layer is provided as one or more layers on the support. When it is provided as a monolayer, the layer must contain a non-photosensitive silver source (preferably a silver salt of an organic acid), photosensitive silver halide, reducing agent and binder, and it may contain additional materials such as toning agent, coating aid and other auxiliary agents. When the layer is bilayer, the first image-forming layer (in general, the layer adjacent to the support) must contain a silver salt of an organic acid and silver halide, and the second image-forming layer or said two layers must contain the other ingredients. Multicolor photothermographic material may contain these two layers for each color, or may contain all necessary ingredients in a single layer as described in U.S. Pat. No. 4,708,928. As for multicolor photothermographic materials containing multiple dyes, each emulsion layer is kept individually by using a functional or non-functional barrier layer between the adjacent photosensitive layers as described in U.S. Pat. No. 4,460,681.

In the image-forming layer of the present invention, various types of dyes and pigments may be used to improve color tone, to prevent interference fringes generated during laser exposure, and to prevent irradiation (e.g., C.I. Pigment Blue 60, C.I. Pigment Blue 64, C.I. Pigment Blue 15:6). These techniques are detailed in International Patent Publication WO98/36322, JP-A-10-268465, JP-A-11-338098 and so forth.

In the present invention, a colorant that shows absorption maximum in the range of 300–450 nm may be added in order to improve change of silver color tone and images with time. Such a colorant is described in JP-A-62-210458, JP-A-63-104046, JP-A-63-103235, JP-A-63-208846, JP-A-63-306436, JP-A-63-314535, JP-A-01-61745, JP-A-2001-100363 and so forth. Such a colorant is usually added in an amount of 0.1 $mg/m^2$ to 1 $g/m^2$, and it is preferably added to a back layer, which is provided on the side opposite to the side on which the photosensitive layer is provided.

The photothermographic material of the present invention is preferably a so-called single-sided photothermographic material comprising at least one image-forming layer containing a silver halide emulsion on one side of support, and a back layer on the other side.

In the present invention, the photothermographic material preferably contains a matting agent for improving the transferability of the material. Matting agents are described in JP-A-11-65021, paragraphs 0126 to 0127. The matting agent is preferably added in an amount of 1–400 $mg/m^2$, more preferably 5–300 $mg/m^2$, as the amount per 1 $m^2$ of the photothermographic material. In the present invention, the matting agent may have a regular shape or irregular shape, but it preferably has a regular shape, and a spherical shape is preferably used. The matting agent preferably has a mean particle size of 0.5–10 $\mu$m, more preferably 1.0–8.0 $\mu$m, further preferably 2.0–6.0 $\mu$m. The variation coefficient of size distribution is preferably 50% or less, more preferably 40% or less, further preferably 30% or less. The variation coefficient used herein means a value represented as (standard deviation of particle size)/(average of particle size)×100. It is also preferable to use together two kinds of matting agents having a small variation coefficient and a ratio of mean particle sizes larger than 3. While the matting degree of the surface of the emulsion layer is not particularly limited so long as the material is free from stardust defects, Beck's smoothness of the surface is preferably 30–2000 seconds, more preferably 40–1500 seconds. Beck's smoothness can be easily determined according to Japanese Industrial Standard (JIS) P8119, "Test Method for Smoothness of Paper and Paperboard by Beck Test Device" and TAPPI Standard Method T479.

In an embodiment of the present invention utilizing a back layer, the matting degree of the back layer is preferably 10–1200 seconds, more preferably 20–800 seconds, further preferably 40–500 seconds, in terms of the Beck's smoothness.

In the present invention, the matting agent is preferably incorporated in the outermost surface layer or a layer which functions as the outermost surface layer of the photothermographic material, or alternatively, in a layer close to the outer surface or a layer which acts as a so-called protective layer. The back layers that are applicable to the photothermographic material are described in JP-A-11-65021, paragraphs 0128 to 0130.

The photothermographic material of the present invention preferably has a film surface pH of 7.0 or less, more preferably 6.6 or less, before heat development. While the lower limit is not particularly defined, it is normally around 3. The most preferred pH range is 4–6.2. For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. Further, a combination of a nonvolatile base such as sodium hydroxide, potassium hydroxide and lithium hydroxide and ammonia is also preferably used. A method for measuring the film surface pH is described in JP-A-2000-2843 (Japanese Patent Application No. 11-87297), paragraph 0123.

In the photothermographic material of the present invention, a hardening agent may be added to the photosensitive layer, protective layer, back layer and other layers. Examples of the hardening agent are described in T. H. James, "*THE THEORY OF THE PHOTOGRAPHIC PROCESS, FOURTH EDITION*", Macmillan Publishing Co., Inc., 1977, pp. 77–87. There may be preferably used chromium alum, 2,4-dichloro-6-hydroxy-s-triazine sodium salt, N,N-ethylenebis-(vinylsulfonacetamide), N,N-propylenebis(vinylsulfonacetamide), as well as the polyvalent metal ions described on page 78 of the above article, polyisocyanates described in U.S. Pat. No. 4,281,060 and JP-A-6-208193; epoxy compounds described in U.S. Pat. No. 4,791,042; vinylsulfone compounds described in JP-A-62-89048 and so forth.

The hardening agent is added to a coating solution as a solution. Preferred addition time of the solution to the coating solution of the protective layer resides in a period of from 180 minutes before the coating to just before the coating, preferably 60 minutes to 10 seconds before the coating. The method and conditions for mixing are not particularly limited so long as the effect of the present invention can be sufficiently attained. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

Surfactants that can be used in the present invention are described in JP-A-11-65021, paragraph 0132; usable solvents are described in the above patent document in paragraph 0133; usable supports are described in the above patent document in paragraph 0134; usable antistatic and electroconductive layers are described in the above patent document in paragraph 0135; usable methods for forming color images are described in the above patent document in paragraph 0136; and lubricants are described in JP-A-11-84573, paragraphs 0061–0064 and Japanese Patent Application No. 11-106881, paragraphs 0049–0062.

The photothermographic material of the present invention preferably has an electroconductive layer containing a metal oxide. As a conductive material contained in the electroconductive layer, a metal oxide of which conductivity is increased by introducing oxygen defects or heterogenous metal atoms into the metal oxide is preferably used. Preferred examples of the metal oxide include ZnO, $TiO_2$ and $SnO_2$, and addition of Al or In to $ZnO_2$, addition of Sb, Nb, P, a halogen element etc. to $SnO_2$ and addition of Nb, Ta etc to $TiO_2$ are preferred. $SnO_2$ added with Sb is particularly preferred. The amount of heteroatoms is preferably in the range of 0.01–30 mol %, more preferably 0.1–10 mol %.

Although the metal oxide may have any shape such as spherical form, acicular form and tabular form, acicular grains having a long axis/short axis ratio of 2.0 or more, preferably 3.0–50, are preferred in view of impartation of electroconductivity. The amount of the metal oxide is preferably in the range of 1–1000 mg/m$^2$, more preferably 10–500 mg/m$^2$, further preferably 20–200 mg/m$^2$. Although the electroconductive layer according to the present invention may be disposed on either the emulsion layer side or the back side, it is preferably disposed between a support and a back layer. Specific examples of the electroconductive layer used for the present invention are described in JP-A-7-295146 and JP-A-11-223901. In the present invention, it is preferable to use a fluorine-containing surfactant. Specific examples of the fluorine-containing surfactant include the compounds described in JP-A-10-197985, JP-A-2000-19680, JP-A-2000-214554 and so forth. The polymer fluorine-containing surfactants described in JP-A-9-281636can also preferably be used. In the present invention, the fluorine-containing surfactants disclosed in Japanese Patent Application No. 2000-206560 are particularly preferably used.

Preferably used as a transparent support is a polyester film, in particular, polyethylene terephthalate film, subjected to a heat treatment in a temperature range of 130–185° C. in order to relax the internal distortion formed in the film during the biaxial stretching so that thermal shrinkage distortion occurring during the heat development can be eliminated. When the photothermographic material is for medical use, the transparent support may be colored with blue dyes (e.g., with Dye-1 described in Examples of JP-A-8-240877), or may be colorless. For the support, techniques for undercoating described in JP-A-11-84574 (utilizing water-soluble polyester), JP-A-10-186565 (utilizing styrene/butadiene copolymer), JP-A-2000-39684 and Japanese Patent Application No. 11-106881, paragraphs 0063–0080 (utilizing vinylidene chloride copolymer) and so forth are preferably used. As for antistatic layers and undercoating, techniques disclosed in JP-A-56-143430, JP-A-56-143431, JP-A-58-62646, JP-A-56-120519, JP-A-11-84573, paragraphs 0040–0051, U.S. Pat. No. 5,575,957, JP-A-11-223898, paragraphs 0078–0084 and so forth can also be used.

The photothermographic material is preferably a monosheet type material (the monosheet type material uses no additional sheet such as an image receiving material, and can form images directly on the photothermographic material itself).

The photothermographic material may further contain an antioxidant, stabilizer, plasticizer, ultraviolet absorber or coating aid. Such additives may be added to any of photosensitive layers or non-photosensitive layers. For these additives, WO98/36322, EP803764A1, JP-A-10-186567, JP-A-10-18568 and so forth can be referred to.

In the preparation of the photothermographic material of the present invention, coating solutions for forming the layers may be coated by any methods. Specific examples thereof include various types of coating techniques, for example, extrusion coating, slide coating, curtain coating, dip coating, knife coating, flow coating, extrusion coating utilizing a hopper of the type described in U.S. Pat. No. 2,681,294 and so forth. Preferred examples include extrusion coating and slide coating described in Stephen F. Kistler, Petert M. Schweizer, "LIQUID FILM COATING", published by CHAPMAN & HALL Co., Ltd., 1997, pp.399–536, and the slide coating is most preferably used. An example of the shape of a slide coater used for the slide coating is shown in FIG. 11b, 1, on page 427 of the aforementioned reference. If desired, two or more layers may be formed at the same time, for example, according to the methods described from page 399 to page 536 of the aforementioned reference, or the methods described in U.S. Pat. No. 2,761,791 and British Patent No. 837,095.

The coating solution for a layer containing a silver salt of an organic acid used in the preparation of the photothermographic material of the present invention is preferably a so-called thixotropic flow. As for this technique, JP-A-11-52509 can be referred to. A coating solution for a layer containing a silver salt of an organic acid used in the present invention preferably has a viscosity of 400–100,000 mPa·s, more preferably 500–20,000 mPa·s, at a shear rate of 0.1 sec$^{-1}$. The viscosity is preferably 1–200 mPa·s, more preferably 5–80 mPa·s, at a shear rate of 1000 sec$^{-1}$.

Other techniques that can be used for the photothermographic material of the present invention are also described in EP803764A1, EP883022A1, WO98/36322, JP-A-56-62648, JP-A-58-62744, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536, JP-A-11-133537, JP-A-11-133538, JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, Japanese Patent Application Nos. 2000-187298, 2000-10229, 2000-47345, 2000-206642, 2000-98530, 2000-98531, 2000-112059, 2000-112060, 2000-112104, 2000-112064 and 2000-171936.

In order to suppress fluctuation of photographic performance during storage before use or improve curling or deformation due to rolling, the photothermographic material of the present invention is preferably packaged with a packaging material showing a low oxygen permeability and/or low moisture permeability. The oxygen permeability is preferably 50 mL/atm·m$^2$·day or less, more preferably 10 mL/atm·m$^2$·day or less, further preferably 1.0 mL/atm·m$^2$·day or less, at 25° C. The moisture permeability is preferably 10 g/atm·m$^2$·day or less, more preferably 5 g/atm·m$^2$·day or less, further preferably 1 g/atm·m$^2$·day or less. Specific examples of such a packaging material showing a low oxygen permeability and/or low moisture permeability include the packaging materials disclosed in JP-A-8-254793 and JP-A-2000-206653.

Although the development method for the photothermographic material of the invention is not particularly limited, a photothermographic material exposed imagewise is usually developed by heating. The temperature for the development is preferably 80–250° C., more preferably 100–140° C., further preferably 110–130° C. The development time is preferably 1–60 seconds, more preferably 3–30 seconds, further preferably 5–25 seconds, particularly preferably 7–15 seconds.

For the heat development, although either a drum heater or a plate heater may be used, preferred is a plate heater system. For heat development by the plate heater system, the method described in JP-A-11-133572 is preferred. The plate heater system described in this reference is a heat development apparatus wherein a photothermographic material on which a latent image is formed is brought into contact with heating means in a heat development section to obtain a visible image. In this apparatus, the heating means comprises a plate heater, and a plurality of presser rollers are disposed facing to one surface of the plate heater. Heat development of the photothermographic material is attained by passing the material between the presser rollers and the plate heater. The plate heater is preferably sectioned into 2 to 6 stages, and the temperature of the top stage is preferably kept lower by 1–10° C. or so than that of the others. For example, four plate heaters are used, of which temperature can be independently controlled, and temperature of the heaters are controlled to be 112° C., 119° C., 121° C. and 121° C., respectively. Such a method is also described in JP-A-54-30032, and such a plate heater system can remove moisture and organic solvent contained in the photothermographic material out of the material, and prevent deformation of the support of the photothermographic material due to rapid heating of the material.

While the photothermographic material of the present invention can be exposed in any manner, as light source of exposure, laser rays are preferred. As the laser used in the present invention, gas lasers (He—Ne), dye lasers, semiconductor lasers and so forth are preferred. A combination of semiconductor laser and second harmonic generating device may also be used. Preferred are gas or semiconductor lasers for red emission.

As an example of a laser imager for medical use provided with a light exposure section and a heat development section, Fuji Medical Dry Laser Imager FM-DP L can be mentioned. FM-DP L is explained in Fuji Medical Review, No. 8, pages 39–55, and the techniques described therein can of course be used in laser imagers for the photothermographic material of the present invention. Further, the photothermographic material of the present invention can be used as a photothermographic material for laser imagers in "AD network", which was proposed by Fuji Medical System as a network system that conforms to the DICOM standard.

The photothermographic material forms a monochromatic image based on silver image, and is preferably used as a photothermographic material for use in medical diagnosis, industrial photography, printing and COM.

EXAMPLES

The present invention will be specifically explained with reference to the following examples. The materials, regents, ratios, procedures and so forth shown in the following examples can be optionally changed so long as such change does not depart from the spirit of the present invention. Therefore, the scope of the present invention is not limited to the following examples.

Example 1

Preparation of Supports A1 to A4 Having Back Layer (Preparation of Dye Dispersion 101)

In an amount of 9 g of Dye 51 (Exemplary Compound 51) and 2241 mL of distilled water were sufficiently stirred by using a high-speed stirring machine (Multidisperser PB95, round fin type, produced by SMT) to obtain aqueous slurry of Dye 51. Then, the slurry was added with 2250 g of 10 weight % aqueous solution of gelatin with stirring and mixed by stirring at 40° C. for 30 minutes. The obtained gelatin dispersion of Dye 51 was filtered through a polypropylene filter having an effective pore size of 3 μm and kept at a cold dark place at 10° C. or lower to form jellylike solid for practical use.

(Preparation of Dye Dispersion 102)

In a similar procedure, Dye dispersion 102 was obtained in the same manner as the preparation method of Dye dispersion 101 except that Dye 67 (Exemplary Compound 67) was used instead of Dye 51.

(Preparation of Comparative Dye Solid Microparticle Dispersion 151) In an amount of 6.0 kg of Cyanine dye compound 1 mentioned below, 3.0 kg of surfactant (sodium p-dodecylbenzenesulfonate), 0.6 kg of surfactant (trade name: Demor SNB, Kao Corp.) and 0.15 kg of antifoaming agent (trade name: Safinol 104E, Nisshin Kagaku Co.) were mixed with distilled water to obtain a total amount of 60 kg. The mixture was bead-dispersed by using a sand mill of horizontal type (UVM-2, Imex). Spectral absorbance of this dispersion was measured, and the dispersion operation was continued until a ratio of absorbance at 650 nm and absorbance at 750 nm (D650/D750) reached 5.0 or more. The obtained dispersion was diluted with distilled water to obtain a cyanine dye concentration of 6 weight % and filtered through a filter (mean pore size: 1 μm) to remove dusts for practical use (Dye dispersion 151).

(Preparation of Comparative Dye Dispersion Solution 152)

Dye dispersion 152 was prepared in the same manner as the preparation method of Dye dispersion 101 except that Dye A mentioned below (described in JP-A-11-228698, page 38, Examples) was used in the same amount instead of Dye 51 used in the preparation method of Dye dispersion 101.

Cyanine dye compound 1

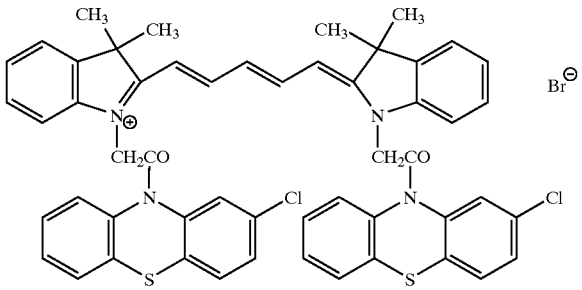

Dye A

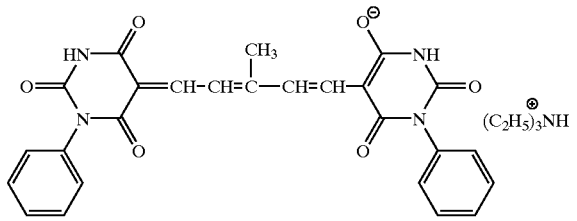

(Evaluation of Storage Stability of Dispersion)

Each of the obtained dispersions was sealed with stops in a glass tube having a height of 30 cm and stored with refrigeration at 10° C. After left standing for 10 days, solid contents of the dispersion for portions at 2 cm and 28 cm from the top of the glass tube were measured. Storage stability was calculated in accordance with the following equation, and evaluated according to the relative criteria mentioned below.

Storage stability (%)=(Solid content at 2 cm from top)/(Solid content at 28 cm from top)

⊙: Storage stability is 95% or higher, and no problem is caused for practical use.

○: Storage stability is lower than 95% but 70% or higher, and no problem is caused for practical use.

X: Storage stability is lower than 70% and thus extremely poor, and problem is seen for practical use.

The results are shown in Table 1 mentioned below.

TABLE 1

| Dye dispersion No. | Dye No. | Storage stability of dispersion | Note |
|---|---|---|---|
| 101 | 51 | ⊙ | Invention |
| 102 | 67 | ⊙ | Invention |
| 151 | — | X | Comparative |
| 152 | — | ○ | Comparative |

From the results shown in Table 1, it was found that the dye dispersions containing a dye as aggregates showed superior storage stability.

Then, Supports A1 to A4 having a back layer were produced by using these prepared dye dispersions.

(Preparation of PET Support)

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, then melted at 300° C., and extruded from a T-die and rapidly cooled to form an unstretched film having such a thickness that the film should have a thickness of 175 μm after thermal fixation. This film was stretched along the longitudinal direction by 3.3 times using rollers of different peripheral speeds, and then stretched along the transverse direction by 4.5 times using a tenter. The temperatures of these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 μm was obtained.

(Surface Corona Discharge Treatment)

By using a solid state corona discharging treatment machine Model 6KVA manufactured by Piller Inc., both surfaces of the support were treated at room temperature at 20 m/minute. The readings of electric current and voltage during the treatment indicated that the support underwent the treatment of 0.375 kV·A·minute/m$^2$. The discharging frequency of the treatment was 9.6 kHz, and the gap clearance between the electrode and the dielectric roll was 1.6 mm.

(Preparation of Support Having Undercoat Layers)

(1) Preparation of Coating Solutions for Undercoat Layers

| | |
|---|---|
| Formulation 1 (for undercoat layer on photosensitive layer side) | |
| Pesresin A-515GB (Takamatsu Yushi K. K., 30 weight % solution) | 234 g |
| Polyethylene glycol monononylphenyl ether (mean ethylene oxide number = 8.5, 10 weight % solution) | 21.5 g |
| MP-1000 (Soken Kagaku K. K. polymer microparticles, mean particle size: 0.4 μm) | 0.91 g |
| Distilled water | 744 mL |
| Formulation 2 (for 1st layer on back surface) | |
| Styrene/butadiene copolymer latex (solid content: 40 weight %, weight ratio of styrene/butadiene = 68/32) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 mL |
| Distilled water | 854 mL |
| Formulation 3 (for 2nd layer on back surface side) | |
| $SnO_2$/SbO (weight ratio: 9/1, mean particle size: 0.038 μm, 17 weight % dispersion) | 84 g |
| Gelatin (10% aqueous solution) | 89.2 g |
| Metorose TC-5 (Shin-Etsu Chemical Co., Ltd., 2% aqueous solution) | 8.6 g |
| MP-1000 (Soken Kagaku K. K.) | 0.01 g |
| 1 weight % Aqueous solution of sodium dodecylbenzenesulfonate | 10 mL |
| NaOH (1 weight %) | 6 mL |
| Proxel (ICI Co.) | 1 mL |
| Distilled water | 805 mL |

On one surface (photosensitive layer side) of the aforementioned biaxially stretched polyethylene terephthalate support having a thickness of 175 μm, both of which surfaces had been subjected to the above corona discharging treatment, the undercoating solution of Formulation 1 was coated by a wire bar in a wet coating amount of 6.6 mL/m$^2$ (for one surface) and dried at 180° C. for 5 minutes. Then, the opposite surface (back surface) thereof was coated with the undercoating solution of Formulation 2 by a wire bar in a wet coating amount of 5.7 mL/m$^2$ and dried at 180° C. for 5 minutes. The back surface thus coated was further coated with the undercoating solution of Formulation 3 by a wire bar in a wet coating amount of 7.7 mL/m$^2$ and dried at 180° C. for 6 minutes to prepare a support having undercoat layers.

(Preparation of Coating Solution 1 for Antihalation Layer)

The following components were added to a container kept at 40° C. to form Coating solution 1 for antihalation layer of back surface.

| | |
|---|---|
| Gelatin (containing 30 ppm of Ca ions) | 279 g |
| Dye dispersion shown in Table 2 mentioned below | 958 g |
| Benzoisothiazolinone | 0.3 g |
| Polymethyl methacrylate microparticles (mean particle size: 8 μm, standard deviation of particle size: 0.4) | 48.5 g |
| Sodium polystyrenesulfonate | 2.2 g |
| Acrylic acid/ethyl acrylate copolymer (copolymerization ratio: 5:95 | 49.8 g |

-continued

| | |
|---|---|
| (weight ratio)) | |
| N,N'-ethylenebis (vinylsulfoneacetamide) | 16.5 g |
| Sodium hydroxide | 2.23 g as solid |
| $H_2O$ | 6169 mL |

(Preparation of Coating Solution 1 for Protective Layer of Back Surface)

The following components were added to a container kept at 40° C. to form Coating solution 1 for protective layer of back surface.

| | |
|---|---|
| Gelatin (containing 30 ppm of Ca ions) | 655 g |
| Sodium polystyrenesulfonate | 2.25 g |
| Benzoisothiazolinone | 0.93 g |
| Aerosol OT (American Cyanamid) | 5.0 g |
| Fluorine-containing surfactant (F-2: polyethylene glycol mono (N-perfluorooctylsulfonyl-N-propyl-2-aminoethyl) ether [average polymerization degree of ethylene oxide: 15] | 4.2 g |
| Acrylic acid/ethyl acrylate copolymer (copolymerization ratio: 5:95 (weight ratio)) | 100 g |
| Liquid paraffin emulsion | 53.5 g As liquid paraffin |
| Sodium hydroxide | 1.1 g as solid |
| $H_2O$ | 8030 mL |

(Preparation of Supports A1 to A4 Having Back Layer)

On the back layer side of the aforementioned undercoated support, Coating solution 1 for antihalation layer and Coating solution 1 for protective layer of back surface were simultaneously coated as stacked layers so that the coated gelatin amounts could become 1.45 g/m$^2$ and 0.79 g/m$^2$, respectively, and dried to form a back layer. The conditions for coating and drying were as follows. The coating was performed at a speed of 160 m/min, the clearance between the end of the coating die and the support was set to be 0.10–0.30 mm, and pressure of the decompression chamber was set to be lower than the atmospheric pressure by 196–882 Pa. The support was destaticized with an ionic wind before the coating. The coating solutions were cooled with a wind at a dry bulb temperatures of 10–20° C. in a subsequent chilling zone, then transported without contact, and dried with a dry wind at a dry bulb temperatures of 23–45° C. and a wet bulb temperature of 15–21° C. in a coiled type drying apparatus of non-contact type. After the drying, the coated support was conditioned for moisture content at 25° C. and relative humidity of 40–60% and heated so that the film surface temperature could become 70–90° C. After the heating, the film surface was cooled to 25° C.

Matting degree of the produced Supports A1 to A4 was 130 seconds for the back surfaces.

(Evaluation of Spectral Absorption)

By using a spectrophotometer (U-3500: Hitachi), spectral absorptions of Supports A1 to A4 having a back layer were measured. As a control sample, there was used a support prepared in the same manner except that only the dye was excluded from the coating solution for forming a back layer. The measurement was performed for a wavelength range of 350–900 nm. From the obtained spectral absorptions, the maximum absorption wavelength and a wavelength width at ½ of the absorbance at the maximum absorption wavelength were calculated. The results are shown in Table 2. The maximum absorption wavelengths in solutions of the dyes are also mentioned.

TABLE 2

| Support having back layer No. | Dye dispersion No. | Maximum absorption wavelength (nm) | Half band width of maximum absorption peak (nm) | Maximum absorption wave-length in solution (nm) | Note |
|---|---|---|---|---|---|
| A1 | 101 | 660 | 25 | 578 (MeOH) | Invention |
| A2 | 102 | 628 | 20 | 553 (MeOH) | Invention |
| A3 | 151 | 656 | 120 | 642 (MeOH) | Comparative |
| A4 | 152 | 780 | 45 | 618 (DMF) | Comparative |

From the results shown in Table 2, it was found that Supports A1 and A2 having a back layer containing aggregates of dye showed extremely sharp absorption in the wavelength range of 600–750 nm. The maximum absorption wavelengths of the dyes in the back layers shown in Table 2 significantly shifted to the longer wavelength side compared with the maximum absorption wavelengths of the dyes in solutions, and thus it could be seen that Dyes 51 and 67 formed aggregates in the back layers.

Example 2

(Preparation of Silver Halide Emulsions)

<<Preparation of Silver Halide Emulsion 1>>

In an amount of 1421 mL of distilled water was added with 3.1 mL of 1 weight % potassium bromide solution, and further added with 3.5 mL of 0.5 mol/L sulfuric acid and 31.7 g of phthalized gelatin. Separately, Solution A was prepared by adding distilled water to 22.22 g of silver nitrate to dilute it to 95.4 mL, and Solution B was prepared by diluting 15.3 g of potassium bromide and 0.8 g of potassium iodide with distilled water to a volume of 97.4 mL. To the aforementioned mixture maintained at 30° C. and stirred in a stainless steel reaction vessel, the whole volume of Solution A and Solution B was added over 45 seconds at constant flow rates. Then, the mixture was added with 10 mL of 3.5 weight % aqueous hydrogen peroxide solution, and further added with 10.8 mL of 10 weight % aqueous solution of benzimidazole. Further, Solution C was prepared by adding distilled water to 51.86 g of silver nitrate to dilute it to 317.5 mL, and Solution D was prepared by diluting 44.2 g of potassium bromide and 2.2 g of potassium iodide with distilled water to a volume of 400 mL. The whole volume of Solution C was added to the mixture over 20 minutes at a constant flow rate. Solution D was added by the control double jet method while pAg was maintained at 8.1. Hexachloroiridic acid (III) potassium salt in an amount of $1\times10^{-4}$ mole per mole of silver was added at one time 10 minutes after the addition of Solutions C and D was started. Further, an aqueous solution of potassium iron(II) hexacyanide in an amount of $3\times10^{-4}$ mole per mole of silver was added at one time 5 seconds after the addition of Solution C was completed. Then, the mixture was adjusted to pH 3.8 by using 0.5 mol/L sulfuric acid, and the stirring was terminated. Then, the mixture was subjected to precipitation, desalting and washing with water, and adjusted to pH 5.9 with 1 mol/L sodium hydroxide to form a silver halide dispersion having pAg of 8.0.

The aforementioned silver halide dispersion was added with 5 mL of a 0.34 weight % methanol solution of 1,2-benzisothiazolin-3-one with stirring at 38° C., and after 40 minutes since then, added with a methanol solution of Spectral sensitizing dye A and Sensitizing dye B in a molar ratio of 1:1 in an amount of $1.2\times10^{-3}$ mole as the total amount of Spectral sensitizing dye A and Sensitizing dye B per mole of silver. After 1 minutes, the mixture was warmed to 47° C., and 20 minutes after the warming, added with $7.6\times10^{-5}$ mole of sodium benzenethiosulfonate per mole of silver as a methanol solution. After further 5 minutes, the mixture was added with Tellurium sensitizer C as a methanol solution in an amount of $2.9\times10^{-4}$ mole per mole of silver, followed by ripening for 91 minutes. The mixture was added with 1.3 mL of 0.8 weight % methanol solution of N,N'-dihydroxy-N"-diethylmelamine, and 4 minutes later, added with $4.8\times10^{-3}$ mole per mole of silver of 5-methyl-2-mercaptobenzimidazole and $5.4\times10^{-3}$ mole per mole of silver of 1-phenyl-2-heptyl-5-mercapto-1,3,4-triazole as a methanol solution to prepare Silver halide emulsion 1.

The grains in the prepared silver halide emulsion were silver iodobromide grains having a mean diameter of 0.042 μm as spheres and a variation coefficient of 20% for mean diameter as spheres and uniformly containing 3.5 mole % of iodine. The grain size and others were obtained from averages for 1000 grains by using an electron microscope. The [100] face ratio of these grains was determined to be 80% by the Kubelka-Munk method.

<<Preparation of Silver Halide Emulsion 2>>

Silver halide emulsion 2 was prepared in the same manner as the preparation of Silver halide emulsion 1 except that the liquid temperature upon grain formation was changed from 30° C. to 47° C., Solution B was prepared by diluting 15.9 g of potassium bromide with distilled water to a volume of 97.4 mL, Solution D was prepared by diluting 45.8 g of potassium bromide with distilled water to a volume of 400 mL, addition time of Solution C was changed to 30 minutes and potassium iron(II) hexacyanide was not used. As in the case of Silver halide emulsion 1, the steps of precipitation, desalting, washing with water and dispersion were performed. Furthermore, in the same manner as in the case of Silver halide emulsion 1 except that the addition amount of a methanol solution of Spectral sensitizing dye A and Sensitizing dye B in a molar ratio of 1:1 was changed to $7.5\times10^{-4}$ mole as the total amount of Spectral sensitizing dye A and Sensitizing dye B per mole of silver, the addition amount of Tellurium sensitiser C was changed to $1.1\times10^{-4}$ mole per mole of silver, and the addition amount of 1-phenyl-2-heptyl-5-mercapto-1,3,4-triazole was changed to $3.3\times10^{-3}$ mole of per mole of silver, spectral sensitization, chemical sensitization, and addition of 5-methyl-2-mercaptobenzimidazole and 1-phenyl-2-heptyl-5-mercapto-1,3,4-traizole were performed to obtain Silver halide emulsion 2. Emulsion grains of Silver halide emulsion 2 were pure silver bromide cubic grains having a mean grain diameter of 0.080 μm as spheres and a variation coefficient of 20% for diameter as spheres.

<<Preparation of Silver Halide Emulsion 3>>

Silver halide emulsion 3 was prepared in the same manner as the preparation of Silver halide emulsion 1 except that the liquid temperature upon grain formation was changed from 30° C. to 27° C. Further, as in the case of Silver halide emulsion 1, the steps of precipitation, desalting, washing with water and dispersion were performed. Then, Silver halide emulsion 3 was obtained in the same manner as in the case of Silver halide emulsion 1 except that Spectral sensitizing dye A and Spectral sensitizing dye B were added in a molar ratio of 1:1 as a solid dispersion (gelatin aqueous solution) in an amount of $6\times10^{-3}$ mole per mole of silver as the total amount of Spectral sensitizing dye A and Spectral sensitizing dye B and the addition amount of Tellurium sensitizer C was changed to $5.2\times10^{-4}$ mole per mole of silver. Emulsion grains of Silver halide emulsion 3 were silver iodobromide grains having a mean grain diameter of 0.034 μm as spheres and a variation coefficient of 20% for diameter as spheres and uniformly containing 3.5 mole % of iodine.

<<Preparation of Mixed Emulsion A for Coating Solution>>

In an amount of 70% by weight of Silver halide emulsion 1, 15% by weight of Silver halide emulsion 2 and 15% by weight of Silver halide emulsion 3 were mixed and added with benzothiazolium iodide in an amount of $7\times10^{-3}$ mole per mole of silver as a 1 weight % aqueous solution and further added with water so that the silver halide content per 1 kg of mixed emulsion for coating could become 38.2 g to form Mixed emulsion A for coating solution.

<<Preparation of Aliphatic Acid Silver Salt Dispersion>>

In an amount of 87.6 kg of behenic acid (Edenor C22–85R, trade name, Henkel Co.), 423 L of distilled water, 49.2 L of 5 mol/L aqueous solution of NaOH and 120 L of tert-butyl alcohol were mixed and allowed to react at 75° C. for one hour with stirring to obtain a solution of sodium behenate. Separately, 206.2 L of an aqueous solution containing 40.4 kg of silver nitrate (pH 4.0) was prepared and kept at 10° C. A mixture of 635 L of distilled water and 30 L of tert-butyl alcohol contained in a reaction vessel kept at 30° C. was added with the whole volume of the aforementioned sodium behenate solution and the whole volume of the aqueous silver nitrate solution with sufficient stirring at constant flow rates over the periods of 93 minutes and 15 seconds and 90 minutes, respectively. In this operation, they were added in such a manner that only the aqueous silver nitrate solution should be added for 11 minutes after starting the addition of the aqueous silver nitrate solution. Then, the addition of the sodium behenate solution was started so that only the sodium behenate solution could be added for 14 minutes and 15 seconds after finishing the addition of the aqueous silver nitrate solution. In this operation, the outside temperature was controlled so that the temperature in the reaction vessel could become 30° C. and the liquid temperature should be constant. The piping of the addition system for the sodium behenate solution was warmed by circulating warmed water outside a double pipe, and temperature was controlled such that the liquid temperature at the outlet orifice of the addition nozzle should become 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature and then the temperature was increased to 35° C. over 30 minutes, followed by ripening for 210 minutes. After completion of the ripening, the solid content was immediately separated by centrifugal filtration and washed with water until electric conductivity of the filtrate became 30 μS/cm. Thus, a silver salt of an organic acid was obtained. The obtained solid content was stored as a wet cake without being dried.

When the shape of the obtained silver behenate grains was evaluated by an electron microscopic photography, the grains were scaly crystals having a=0.14 μm, b=0.4 μm and c=0.6 μm in mean values, mean aspect ratio of 5.2, mean diameter of 0.52 μm as spheres, and variation coefficient of 15% for mean diameter as spheres (a, b and c have the meanings defined above).

To the wet cake corresponding to 260 kg of the dry solid content was added with 19.3 kg of polyvinyl alcohol (PVA-217, trade name) and water to make the total amount 1000 kg, and the mixture was made into slurry by dissolver fins and further pre-dispersed by a pipeline mixer (PM-10, Mizuho Kogyo). Then, the pre-dispersed stock dispersion was treated three times by using a dispersing machine (Microfluidizer M-610, Microfluidex International Corporation, using Z interaction chamber) with a pressure controlled to be 1260 kg/cm$^2$ to obtain silver behenate dispersion. As for the cooling operation, a dispersion temperature of 18° C. was achieved by providing coiled heat exchangers fixed before and after the interaction chamber and controlling the temperature of refrigerant.

(Preparation of Dispersions of Reducing Agents)

<<Preparation of Dispersion of Reducing Agent Complex 1>>

In an amount of 10 kg of Reducing agent complex 1 (1:1 complex of 6,6'-di-t-butyl-4,4'-dimethyl-2,2'-butylidenediphenol and triphenylphosphine oxide), 0.12 kg of triphenylphosphine oxide and 16 kg of 10 weight % aqueous solution of denatured polyvinyl alcohol (Poval MP203, Kuraray Co., Ltd.) were added with 10 kg of water, and mixed sufficiently to form slurry. The slurry was fed by a diaphragm pump to a sand mill of horizontal type (UVM-2, Imex) containing zirconia beads having a mean diameter of 0.5 mm, and dispersed for 4 hours and 30 minutes. Then, the slurry was added with 0.2 g of benzothiazolinone sodium salt and water so that the concentration of the reducing agent could become 22 weight % to obtain a dispersion of Reducing agent complex 1. The reducing agent complex particles contained in the dispersion of reducing agent complex obtained as described above had a median diameter of 0.45 μm and the maximum particle size of 1.4 μm or less. The obtained reducing agent complex dispersion was filtered through a polypropylene filter having a pore size of 3.0 μm to remove dusts and so forth, and used for the preparation of coating solution described below.

<<Preparation of Dispersion of Reducing Agent 2>>

In an amount of 10 kg of Reducing agent 2 (6,6'-di-t-butyl-4,4'-dimethyl-2,2'-butylidenediphenol) and 16 kg of 10 weight % aqueous solution of denatured polyvinyl alcohol (Poval MP203, Kuraray Co., Ltd.) were added with 10 kg of water, and mixed sufficiently to form slurry. The slurry was fed by a diaphragm pump to a sand mill of horizontal type (UVM-2, Imex) containing zirconia beads having a mean diameter of 0.5 mm, and dispersed for 3 hours and 30 minutes. Then, the slurry was added with 0.2 g of benzothiazolinone sodium salt and water so that the concentration of the reducing agent could become 25 weight % to obtain a dispersion of Reducing agent 2. The reducing agent particles contained in the dispersion of reducing agent obtained as described above had a median diameter of 0.40 μm and the maximum particle size of 1.5 μm or less. The obtained reducing agent dispersion was filtered through a polypropylene filter having a pore size of 3.0 μm to remove dusts and so forth, and used for the preparation of coating solution described below.

<<Preparation of Dispersion of Hydrogen Bond-forming Compound 1>>

In an amount of 10 kg of Hydrogen bond-forming compound 1 (tri(4-t-butylphenyl)phosphine oxide) and 16 kg of 10 weight % aqueous solution of denatured polyvinyl alcohol (Poval MP203, Kuraray Co., Ltd.) were added with 10 kg of water, and mixed sufficiently to form slurry. The slurry was fed by a diaphragm pump to a sand mill of horizontal type (UVM-2, Imex) containing zirconia beads having a mean diameter of 0.5 mm, and dispersed for 3 hours and 30 minutes. Then, the slurry was added with 0.2 g of benzothiazolinone sodium salt and water so that the concentration of the hydrogen bond-forming compound could become 25 weight % to obtain a dispersion of Hydrogen bond-forming compound 1. The hydrogen bond-forming compound particles contained in the dispersion of hydrogen bond-forming compound obtained as described above had a median diameter of 0.35 μm and the maximum particle size of 1.5 μm or less. The obtained hydrogen bond-forming compound dispersion was filtered through a polypropylene filter having a pore size of 3.0 μm to remove dusts and so forth, and used for the preparation of coating solution described below.

<<Preparation of Dispersion of Development Accelerator 1>>

In an amount of 10 kg of Development accelerator 1 and 20 kg of a 10 weight % aqueous solution of denatured polyvinyl alcohol (Poval MP203, Kuraray Co., Ltd.) were added with 10 kg of water, and mixed sufficiently to form slurry. The slurry was fed by a diaphragm pump to a sand mill of horizontal type (UVM-2, Imex) containing zirconia beads having a mean diameter of 0.5 mm, and dispersed for 3 hours and 30 minutes. Then, the slurry was added with 0.2 g of benzothiazolinone sodium salt and water so that the concentration of the development accelerator could become 20 weight % to obtain a dispersion of Development accelerator 1. The development accelerator particles contained in the dispersion of development accelerator obtained as described above had a median diameter of 0.48 μm and the maximum particle size of 1.4 μm or less. The obtained development accelerator dispersion was filtered through a polypropylene filter having a pore size of 3.0 μm to remove dusts and so forth, and used for the preparation of coating solution described below.

Solid dispersions of Development accelerators 2, 3 and Toning agent 1 were also obtained as 20 weight % dispersions in the same manner as the method used for obtaining the dispersion of Development accelerator 1

(Preparation of Dispersions of Polyhalogenated Compounds)

<<Preparation of Dispersion of Organic Polyhalogenated Compound 1>>

In an amount of 10 kg of Organic polyhalogenated compound 1 (tribromomethanesulfonylbenzene), 10 kg of 20 weight % aqueous solution of denatured polyvinyl alcohol (Poval MP203, Kuraray Co., Ltd.), 0.4 kg of 20 weight % aqueous solution of sodium triisopropylnaphthalenesulfonate and 14 kg of water were mixed sufficiently to form slurry. The slurry was fed by a diaphragm pump to a sand mill of horizontal type (UVM-2, Imex) containing zirconia beads having a mean particle size of 0.5 mm, and dispersed for 5 hours. Then, the slurry was added with 0.2 g of benzisothiazolinone sodium salt and water so that the concentration of the organic polyhalogenated compound could become 26 weight % to obtain dispersion of Organic polyhalogenated compound 1. The organic polyhalogenated compound particles contained in the organic polyhalogenated compound dispersion obtained as described above had a median particle size of 0.41 μm and the maximum particle size of 2.0 μm or less. The obtained organic polyhalogenated compound dispersion was filtered through a polypropylene filter having a pore size of 10.0 μm to remove dusts and so forth, and used for the preparation of coating solution described below.

<<Preparation of Dispersion of Organic Polyhalogenated Compound 2>>

In an amount of 10 kg of Organic polyhalogenated compound 2 (N-butyl-3-tribromomethanesulfonylbenzamide), 20 kg of 10 weight % aqueous solution of denatured polyvinyl alcohol (Poval MP203, Kuraray Co., Ltd.) and 0.4 kg of 20 weight % aqueous solution of sodium triisopropylnaphthalenesulfonate were mixed sufficiently to form slurry. The slurry was fed by a diaphragm pump to a sand mill of horizontal type (UVM-2, Imex) containing zirconia beads having a mean particle size of 0.5 mm, and dispersed for 5 hours. Then, the slurry was added with 0.2 g of benzisothiazolinone sodium salt and water so that the concentration of the organic polyhalogenated compound could become 30 weight %. This dispersion was warmed to 40° C. for 5 hours to obtain dispersion of Organic polyhalogenated compound 2. The organic polyhalogenated compound particles contained in the organic polyhalogenated compound dispersion obtained as described above had a median particle size of 0.40 μm and the maximum particle size of 1.3 μm or less. The obtained organic polyhalogenated compound dispersion was filtered through a polypropylene filter having a pore size of 3.0 μm to remove dusts and so forth, and used for the preparation of coating solution described below.

<<Preparation of Solution of Phthalazine Compound 1>>

In an amount of 8 kg of denatured polyvinyl alcohol (MP-203, manufactured by Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of Phthalazine compound 1 (6-isopropylphthalazine) to obtain 5 weight % solution of Phthalazine compound 1.

(Preparation of Aqueous Solutions of Mercapto Compounds)

<<Preparation of Aqueous Solution of Mercapto Compound 1>>

In an amount of 7 g of Mercapto compound 1 (1-(3-sulfophenyl)-5-mercaptotetrazole sodium salt) was dissolved in 993 g of water to obtain 0.7 weight % aqueous solution.

<<Preparation of Aqueous Solution of Mercapto Compound 2>>

In an amount of 20 g of Mercapto compound 2 (1-(3-methylureido)-5-mercaptotetrazole sodium salt) was dissolved in 980 g of water to obtain 2.0 weight % aqueous solution.

<<Preparation of Dispersion of Pigment 1>>

In an amount of 64 g of C.I. Pigment Blue 60 and 6.4 g of Demor N manufactured by Kao Corporation was added with 250 g of water and mixed sufficiently to form slurry. Then, 800 g of zirconia beads having a mean particle size of 0.5 mm were placed in a vessel together with the slurry, and the slurry was dispersed by using a dispersing machine (1/4G Sand Grinder Mill, Imex) for 25 hours to obtain dispersion of Pigment 1. The pigment particles contained in the pigment dispersion obtained as described above had a mean particle size of 0.21 μm.

<<Preparation of SBR Latex Solution>>

By using ammonium persulfate as a polymerization initiator and an anionic surfactant as an emulsifier, 70.0 weight % of styrene, 27.0 weight % of butadiene and 3.0 weight % of acrylic acid were emulsion-polymerized and aged at 80° C. for 8 hours. Then, the reaction mixture was cooled to 40° C., adjusted to pH 7.0 with aqueous ammonia and added with Sandet-BL (manufactured by SANYO CHEMICAL INDUSTRIES, LTD.) to a concentration of 0.22 weight %. Further, the mixture was adjusted to pH 8.3 with addition of 5% sodium hydroxide and further adjusted to pH 8.4 with aqueous ammonia. The ratio of $Na^+$ ions and $NH_4^+$ ions used was 1:2.3 (molar ratio). Further, this mixture was added with 0.15 mL of 7% aqueous solution of benzoisothiazolinone sodium salt per 1 kg of the mixture to prepare SBR latex solution.

SBR latex: latex of -St(70.0)-Bu(27.0)-AA(3.0)-(Tg: 22° C., mean particle size: 0.1 μm, concentration: 43 weight %, equilibrated moisture content: 0.6 weight % at 25° C. and relative humidity of 60%, ion conductivity: 4.2 mS/cm (measured for the latex stock solution (43 weight %) at 25° C. by using a conductometer, CM-30S, manufactured by Toa Electronics, Ltd.), pH 8.4)

SBR latex having a different Tg can be prepared in the same manner by changing ratios of styrene and butadiene.

<<Preparation of Coating Solution 1 for Emulsion Layer (Photosensitive Layer)>>

In an amount of 1000 g of the organic acid silver salt dispersion, 276 mL of water, 33.2 g of the dispersion of Pigment 1, 21 g of the dispersion of Organic polyhalogenated compound 1, 58 g of the dispersion of Organic polyhalogenated compound 2, 173 g of the solution of Phthalazine compound 1, 1082 g of the SBR latex solution (Tg: 22° C.), 299 g of the dispersion of Reducing agent complex 1, 6 g of the dispersion of Development accelerator 1, 9 mL of the aqueous solution of Mercapto compound 1 and 27 mL of the aqueous solution of Mercapto compound 2, which were obtained above, were successively added, and 117 g of Mixed emulsion A of silver halide was added and mixed sufficiently immediately before coating to prepare Coating solution 1 for emulsion layer. The obtained Coating solution 1 for emulsion layer was fed as it was to a coating die and coated.

The viscosity of the coating solution for emulsion layer was measured by a B-type viscometer manufactured by Tokyo Keiki K.K. and found to be 25 [mPa·s] at 40° C. (Rotor No. 1, 60 rpm). The viscosity of the coating solution was measured at 25° C. by an RFS fluid spectrometer produced by Rheometric Far East Co., Ltd., and found to be 230, 60, 46, 24 and 18 [mPa·s] at shear rates of 0.1, 1, 10, 100 and 1000 [1/second], respectively. The zirconium content in the coating solution was 0.38 mg per 1 g of silver.

<<Preparation of Coating Solution 2 for Emulsion Layer (Photosensitive Layer)>>

In an amount of 1000 g of the organic acid silver salt dispersion, 276 mL of water, 32.8 g of the dispersion of Pigment 1, 21 g of the dispersion of Organic polyhalogenated compound 1, 58 g of the dispersion of Organic polyhalogenated compound 2, 173 g of the solution of Phthalazine compound 1, 1082 g of the SBR latex solution (Tg: 20° C.), 155 g of the dispersion of Reducing agent 2, 55 g of the dispersion of Hydrogen bond-forming compound 1, 6 g of the dispersion of Development accelerator 1, 2 g of the dispersion of Development accelerator 2, 3 g of the dispersion of Development accelerator 3, 2 g of the dispersion of Toning agent 1 and 6 mL of the aqueous solution of Mercapto compound 2, which were obtained above, were successively added, and 117 g of Mixed emulsion A of silver halide was added and mixed sufficiently immediately before coating to prepare Coating solution 2 for emulsion layer. The obtained Coating solution 2 was fed as it was to a coating die and coated.

The viscosity of the coating solution for emulsion layer was measured by a B-type viscometer manufactured by Tokyo Keiki K.K. and found to be 40 [mPa·s] at 40° C.

(Rotor No. 1, 60 rpm). The viscosity of the coating solution was measured at 25° C. by an RFS fluid spectrometer produced by Rheometric Far East Co., Ltd., and found to be 530, 144, 96, 51 and 28 [mPa·s] at shear rates of 0.1, 1, 10, 100 and 1000 [1/second], respectively. The zirconium content in the coating solution was 0.25 mg per 1 g of silver.

<<Preparation of Coating Solution for Intermediate Layer of Emulsion Layer Side>>

In an amount of 1000 g of polyvinyl alcohol, PVA-205 (Kuraray Co., Ltd.), 272 g of 5 weight % dispersion of pigment and 4200 mL of 19 weight % solution of methyl methacrylate/styrene/butyl acrylate/hydroxyethyl methacrylate/acrylic acid copolymer (copolymerization ratio (by weight): 64/9/20/5/2) latex were added with 27 mL of 5 weight % aqueous solution of Aerosol OT (American Cyanamid), 135 mL of 20 weight % aqueous solution of phthalic acid diammonium salt and water in such an amount giving a total amount of 10000 g and adjusted to pH 7.5 with NaOH to form a coating solution for intermediate layer. This coating solution for intermediate layer was fed to a coating die in such an amount that gave a coating amount of 9.1 mL/m$^2$. The viscosity of the coating solution measured by a B-type viscometer at 40° C. (Rotor No. 1, 60 rpm) was 58 [mPa·s].

<<Preparation of Coating Solution for 1st Protective Layer of Emulsion Layer Side>>

In an amount of 64 g of inert gelatin was dissolved in water, and added with 80 g of 27.5 weight % latex solution of methyl methacrylate/styrene/butyl acrylate/hydroxyethyl methacrylate/acrylic acid copolymer (copolymerization ratio (by weight): 64/9/20/5/2), 23 mL of 10 weight % methanol solution of phthalic acid, 23 mL of 10 weight % aqueous solution of 4-methylphthalic acid, 28 mL of 0.5 mol/L sulfuric acid, 5 mL of 5 weight % aqueous solution of Aerosol OT (American Cyanamid), 0.5 g of phenoxyethanol, 0.1 g of benzoisothiazolinone and water in such an amount that gave a total amount of 750 g to form a coating solution. The coating solution was mixed with 26 mL of 4 weight % chromium alum by a static mixer immediately before coating (coating solution for 1st protective layer of emulsion layer side), and fed to a coating die in such an amount that gave a coating amount of 18.6 mL/m$^2$.

The viscosity of the coating solution measured by a B-type viscometer (Rotor No. 1, 60 rpm) at 40° C. was 20 [mPa·s].

<<Preparation of Coating Solution for 2nd Protective Layer of Emulsion Layer Side>>

In an amount of 80 g of inert gelatin was dissolved in water, and added with 102 g of 27.5 weight % latex solution of methyl methacrylate/styrene/butyl acrylate/hydroxyethyl methacrylate/acrylic acid copolymer (copolymerization ratio (by weight): 64/9/20/5/2), 3.2 mL of 5 weight % solution of fluorine-containing surfactant (F-1: N-perfluorooctylsulfonyl-N-propylalanine potassium salt), 32 mL of 2 weight % aqueous solution of fluorine-containing surfactant (F-2: polyethylene glycol mono(N-perfluorooctylsulfonyl-N-propyl-2-aminoethyl) ether [average polymerization degree of ethylene oxide=15], 23 mL of 5 weight % aqueous solution of Aerosol OT (American Cyanamid), 4 g of polymethyl methacrylate microparticles (mean particle size: 0.7 μm), 21 g of polymethyl methacrylate microparticles (mean particle size: 4.5 μm), 1.6 g of 4-methylphthalic acid, 4.8 g of phthalic acid, 44 mL of 0.5 mol/L sulfuric acid, 10 mg of benzoisothiazolinone and water in such an amount that gave a total amount of 650 g to form a coating solution. The coating solution was further mixed with 445 mL of an aqueous solution containing 4 weight % of chromium alum and 0.67 weight % of phthalic acid by a static mixer immediately before coating (coating solution for 2nd protective layer (surface protective layer) of emulsion layer side) and fed to a coating die in such an amount that gave a coating amount of 8.3 mL/m$^2$.

The viscosity of the coating solution measured by a B-type viscometer (Rotor No. 1, 60 rpm) at 40° C. was 19 [mPa·s].

<<Preparation of Photothermographic Material 1>>

(Preparation of Supports B1 to B4 and B8 to B10 Having Back Layer)

Supports B1 to B4 and B8 to B10 having a back layer were obtained in the same manner as the preparation of Supports A1 to A4 having a back layer prepared in Example 1 by using dye dispersions meeting to the exposure wavelengths, which are mentioned in Table 3, in amounts controlled so that absorbance of the values mentioned in Table 3 could be obtained at the exposure wavelengths instead of the dye dispersion used in the preparation of Supports A1 to A4 having a back layer.

(Preparation of Supports B5 to B7 Having Back Layer)

Supports B5 to B7 having a back layer were prepared in the manner described blow by using the undercoated support used in Example 1.

(Preparation of Coating Solutions for Back Surface)

(Preparation of Base Precursor Solid Microparticle Dispersion (a))

In an amount of 64 g of Base precursor compound 1, 28 g of diphenylsulfone and 10 g of Demor N (Kao Corp.) were mixed with 220 mL of distilled water, and the mixture was subjected to bead dispersion in a sand mill (¼ Gallon Sand Grinder Mill, Imex) to obtain Solid microparticle dispersion (a) of the base precursor compound having a mean particle size of 0.2 μm.

(Preparation of Coating Solution 2 for Antihalation Layer)

The following components were added to a container kept at 40° C. to form Coating solution 2 for antihalation layer of back surface.

| | |
|---|---|
| Gelatin (containing 30 ppm of Ca ions) | 1000 g |
| Dye dispersion 151 | Amount giving absorbance mentioned in Table 3 |
| Benzoisothiazolinone | 2.54 g |
| Polymethyl methacrylate microparticles (mean particle size: 8 μm, standard deviation of particle size: 0.4) | 91 g |
| Sodium polystyrenesulfonate | 19.6 g |
| Acrylic acid/ethyl acrylate copolymer (copolymerization ratio: 5:95 (weight ratio)) | 275.2 g |
| Base precursor solid microparticle dispersion (a) mentioned above | 3090 g |
| Sodium hydroxide | 2.9 g as solid |
| Polyacrylamide | 815.4 g |

The above components were added with distilled water to obtain a total volume of 27277 mL.

(Preparation of Coating Solution 2 for Protective Layer of Back Surface)

The following components were added to a container kept at 40° C. to form Coating solution 2 for protective layer of back surface.

| | |
|---|---|
| Gelatin (containing 30 ppm of Ca ions) | 1000 g |
| Sodium polystyrenesulfonate | 6.75 g |
| Benzoisothiazolinone | 0.875 g |
| Aerosol OT (American Cyanamid) | 12.5 g |
| Fluorine-containing surfactant (F-2: polyethylene glycol mono (N-perfluorooctylsulfonyl-N-propyl-2-aminoethyl) ether [average polymerization degree of ethylene oxide: 15] | 2.96 g |
| Acrylic acid/ethyl acrylate copolymer (copolymerization ratio: 5:95 (weight ratio)) | 150 g |
| Liquid paraffin emulsion | 37.5 g as liquid paraffin |
| Sodium hydroxide | 6.8 g as solid |

The above components were added with distilled water to obtain a total volume of 25006 mL.

On the back layer side of the aforementioned undercoated support, Coating solution 2 for antihalation layer and Coating solution 2 for protective layer of back surface were simultaneously coated as stacked layers so that the coated gelatin amounts could become 0.44 g/m$^2$ and 1.70 g/m$^2$, respectively, and dried to form a back layer. The conditions for coating and drying were the same as those used in Example 1.

Matting degree of the produced Supports B5 to B7 was 130 for each back surface.

Supports B1 to B10 prepared as described above were evaluated as follows.

(Evaluation of Residual Color by Visual Inspection)

Evaluation of residual color was performed as follows. The heat development section of Fuji Medical Dry Laser Imager FM-DP L was reconstituted for experimental use. Each sample not exposed was heat-developed (with four panel heaters set at 112° C., 119° C., 121° C. and 121° C., respectively, for 24 seconds or 14 seconds in total), and then residual color at the center of each sample was measured as spectral absorption by using a spectrophotometer (U-3500: Hitachi) and evaluated according to the following criteria. The support itself was used as a control for the measurement, and the measurement was performed in the range of 350–900 nm.

Residual color and its unevenness were evaluated according to the following relative criteria by visual inspection.

◎: Whole surface is looked uniform, and there is no problem for practical use.

○: Although there is a portion showing a higher residual color density compared with the center portion, there is no problem for practical use.

X: The result is extremely poor and problematic for practical use.

(Evaluation of Absorbance Before and After Heat Development)

Maximum absorbance was measured at a wavelength of 400–600 nm for the supports having a back layer before and after heat development. As a control sample, there was used a support having a back layer produced in the same manner except that only the dye was excluded from the coating solution for back layer. As for the heat development, Fuji Medical Dry Laser Imager FM-DP L of which heat development section was reconstituted for experimental use was used as described above to heat-develop each unexposed sample for 24 seconds or 14 seconds in total, and the maximum absorbance for the aforementioned wavelength range was measured for each sample. The results are shown in Table 3.

TABLE 3

| Support having back layer No. | Dye dispersion No. | Absorbance at 660 nm | Residual color evaluated by visual inspection | Maximum absorbance before heat development (400–600 nm) | Maximum absorbance after heat development (development for 14 seconds, 400–600 nm) | Maximum absorbance after heat development (development for 24 seconds, 400–600 nm) | Note |
|---|---|---|---|---|---|---|---|
| B1 | 101 | 0.2 | ◎ | 0.08 | 0.08 | 0.08 | Invention |
| B2 | 101 | 0.3 | ◎ | 0.06 | 0.06 | 0.06 | Invention |
| B3 | 101 | 0.5 | ◎ | 0.05 | 0.05 | 0.05 | Invention |
| B4 | 151 | 0.2 | X | 0.16 | 0.16 | 0.16 | Comparative |
| B5 | 151 | 0.2 | ○ | 0.16 | 0.11 | 0.05 | Comparative |
| B6 | 151 | 0.3 | ○ | 0.25 | 0.14 | 0.06 | Comparative |
| B7 | 151 | 0.5 | X | 0.45 | 0.19 | 0.10 | Comparative |
| B8 | 152 | 0.1 | ◎ | 0.09 | 0.09 | 0.09 | Comparative |
| B9 | 152 | 0.2 | X | 0.18 | 0.18 | 0.18 | Comparative |
| B10 | 152 | 0.3 | X | 0.27 | 0.27 | 0.27 | Comparative |

<<Preparation of Photothermographic Materials 101 to 110>>

On the undercoated surface on the side opposite to the back surface side of each of the obtained supports having a back layer, an emulsion layer, intermediate layer, first protective layer and second protective layer were simultaneously coated in this order as stacked layers by the slide bead coating method to prepare samples of photothermographic material. In the preparation, temperature was adjusted to 31° C. for the emulsion layer and the intermediate layer, 36° C. for the first protective layer and 37° C. for the second protective layer.

The coating amounts (g/m$^2$) of the compounds in the emulsion layer were as follows.

| | |
|---|---|
| Silver behenate | 5.55 |
| Pigment (C. I. Pigment Blue 60) | 0.036 |
| Polyhalogenated compound 1 | 0.12 |
| Polyhalogenated compound 2 | 0.37 |
| Phthalazine compound 1 | 0.19 |

-continued

| | |
|---|---|
| SBR Latex | 9.97 |
| Reducing agent complex 1 | 1.41 |
| Development accelerator 1 | 0.024 |
| Mercapto compound 1 | 0.002 |
| Mercapto compound 2 | 0.012 |
| Silver halide (as Ag) | 0.091 |

The conditions for coating and drying were as follows.

The coating was performed at a speed of 160 m/min, the clearance between the end of the coating die and the support was set to be 0.10–0.30 mm, and pressure of the decompression chamber was set to be lower than the atmospheric pressure by 196–882 Pa. The support was destaticized with an ionic wind before the coating. The coating solutions were cooled with a wind at a dry bulb temperatures of 10–20° C. in a subsequent chilling zone, then transported without contact, and dried with a dry wind at a dry bulb temperatures of 23–45° C. and a wet bulb temperature of 15–21° C. in a coiled type drying apparatus of non-contact type. After the drying, the coated support was conditioned for moisture content at 25° C. and relative humidity of 40–60% and heated so that the film surface temperature could become 70–90° C. After the heating, the film surface was cooled to 25° C.

Matting degree of the produced photothermographic materials was 550 seconds for each emulsion layer side and 130 seconds for each back surface as Beck's smoothness. Further, pH of film surface was measured and found to be 6.0 for each emulsion layer side.

<<Preparation of Photothermographic Materials 201 to 210>>

Photothermographic materials 201 to 210 were prepared in the same manner as the preparation of Photothermographic materials 101 to 110 except that Coating solution 1 for emulsion layer was changed to Coating solution 2 for emulsion layer, the fluorine-containing surfactants of the protective layers for emulsion layer side were changed from F-1, F-2, F-3 and F-4 to F-5, F-6, F-7 and F-8, respectively, and the fluorine-containing surfactant of the protective layer for back layer side was also changed from F-2 to F-5 of the same amount.

The coating amounts (g/m$^2$) of the compounds in the emulsion layer were as follows.

| | |
|---|---|
| Silver behenate | 5.55 |
| Pigment (C. I. Pigment Blue 60) | 0.036 |
| Polyhalogenated compound 1 | 0.12 |
| Polyhalogenated compound 2 | 0.37 |
| Phthalazine compound 1 | 0.19 |
| SBR Latex | 9.67 |
| Reducing agent 2 | 0.81 |
| Hydrogen bond-forming compound 1 | 0.30 |
| Development accelerator 1 | 0.024 |
| Development accelerator 2 | 0.010 |
| Development accelerator 3 | 0.015 |
| Toning agent 1 | 0.010 |
| Mercapto compound 2 | 0.002 |
| Silver halide (as Ag) | 0.091 |

Relationship of the produced photothermographic materials and the supports having a back layer used is shown in Table 4 mentioned below.

TABLE 4

| Sample No. | Support having back layer No. | Note |
|---|---|---|
| 101 | B1 | Invention |
| 102 | B2 | Invention |
| 103 | B3 | Invention |
| 104 | B4 | Comparative |
| 105 | B5 | Comparative |
| 106 | B6 | Comparative |
| 107 | B7 | Comparative |
| 108 | B8 | Comparative |
| 109 | B9 | Comparative |
| 110 | B10 | Comparative |
| 201 | B1 | Invention |
| 202 | B2 | Invention |
| 203 | B3 | Invention |
| 204 | B4 | Comparative |
| 205 | B5 | Comparative |
| 206 | B6 | Comparative |
| 207 | B7 | Comparative |
| 208 | B8 | Comparative |
| 209 | B9 | Comparative |
| 210 | B10 | Comparative |

Chemical structures of the compounds used in the examples are shown below.

Spectral sensitizing dye A

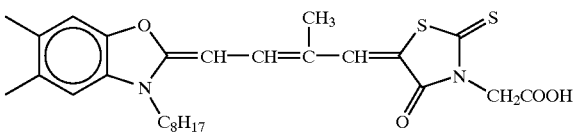

Spectral sensitizing dye B

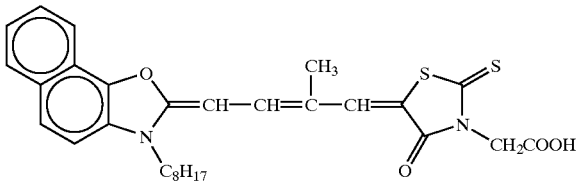

Tellurium sensitizing dye C

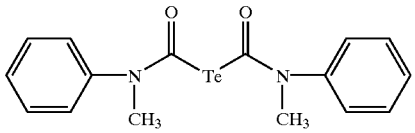

Base precursor compound 1

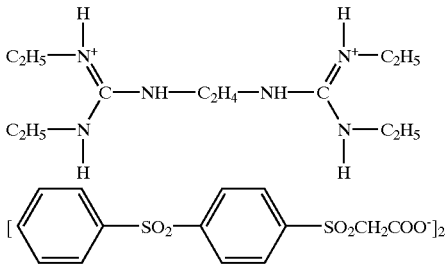

-continued
Reducing agent complex 1 (1:1 Complex of the following compounds)
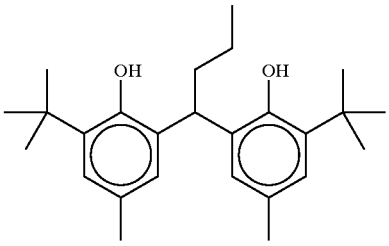
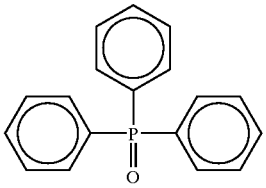
Reducing agent 2
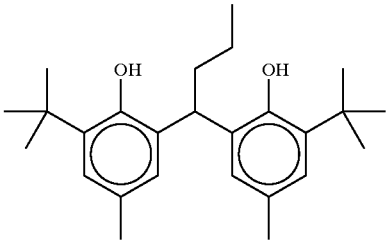
Hydrogen bond-forming compound 1
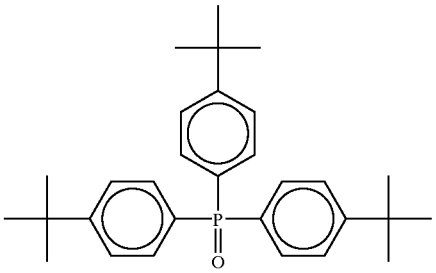
Polyhalogenated compound 1
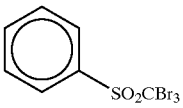
Polyhalogenated compound 2
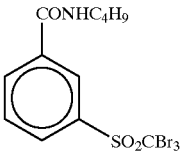
Mercapto compound 1
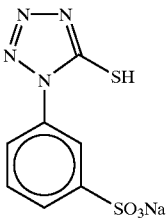
-continued
Mercapto compound 2
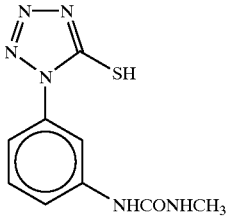
Phthalazine compound 1
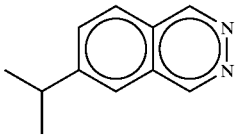
Development accelerator 1
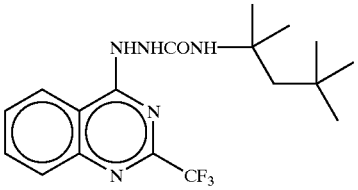
Development accelerator 2
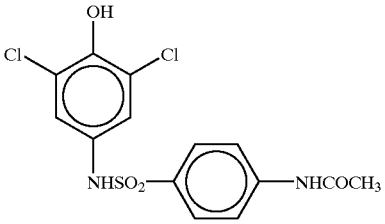
Development accelerator 3
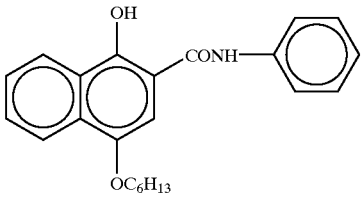
Toning agent 1
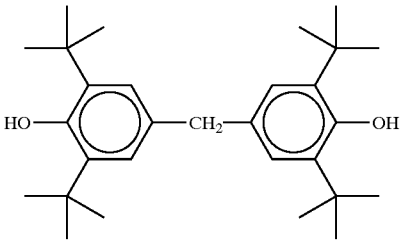
(F-1)
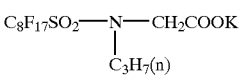
(F-2)
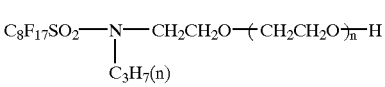
n = 15 (average)
(F-3)
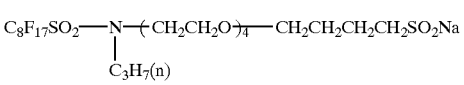

$C_8F_{17}SO_3K$ (F-4)

$CF_3(CF_2)_nCH_2CH_2SCH_2CH_2COOLi$ (F-5)

Mixture of compounds where n=5–11

$CF_3(CF_2)_nCH_2CH_2O(CH_2CH_2O)_mH$ (F-6)

Mixture of compounds where n=5–11 and m=5–15

$CF_3(CF_2)_nCH_2CH_2SO_3Na$ (F-7)

Mixture of compounds where n=5–11

$C_6F_{13}CH_2CH_2SO_3Li$ (F-8)

The obtained photothermographic materials were evaluated as follows.

(Evaluation of Photographic Performance)

Each of the obtained samples was cut into the half size, packaged with the following packaging material in an environment at a temperature of 25° C. and a relative humidity of 50%, and stored at an ordinary temperature for 2 weeks. Then, the sample was evaluated as follows.

Packaging material: PET (10 μm)/PE (12 μm)/aluminum foil (9 μm)/Ny (15 μm)/polyethylene containing 3% of carbon (50μ oxygen permeability: 0 mL/atm·m$^2$·25° C.·day, moisture permeability: 0 g/atm·m$^2$·25° C.·day)

The sample was exposed and heat-developed by using Fuji Medical Dry Laser Imager FM-DP L (provided with a semiconductor laser of maximum output of 60 mW (IIIB) at 660 nm, heat-developed with four panel heaters set at 112° C., 119° C., 121° C. and 121° C., respectively, for 24 seconds in total for Photothermographic materials 101 to 110 or 14 seconds in total for Photothermographic materials 201 to 210), and the obtained image was evaluated by using a densitometer.

Samples 101 to 103 and 201 to 203 according to the present invention all provided images of good contrast.

(Evaluation of Definition)

(Method for Measurement of CTF (Contrast Transfer Function))

A square chart for MTF measurement (spatial frequency: 0–10 cycle/mm) was output by the aforementioned laser imager to expose and heat-develop each sample. Then, each measurement sample was scanned by a microdensitometer with an aperture of 30 μm for the scanning direction and a slit of 500 μm perpendicular to the scanning direction, and sampling was performed every 30 μm to obtain a density profile. Further, the peak of square wave was detected on this density profile to calculate density contrast for each frequency. For the combinations of each photographic material and the aforementioned screen, standardization was attained by regarding the density contrast at a spatial frequency of 0 cycle/mm as 1, and a CTF value at 2 cycle/mm was measured. In this case, a value obtained by subtracting the CFT value from 1 represents CTF degradation degree of definition, and definition of the photographic materials was evaluated with relative values of CTF degradation ratio based on the CTF degradation degree obtained for Photothermographic material 104, of which degradation ratio was taken as 100%.

(Evaluation of Residual Color and Evaluation of Absorbance Before and After Heat Development)

Residual color and absorbance were evaluated by heat-developing each unexposed sample using the aforementioned Fuji Medical Dry Laser Imager FM-DP L, delaminating the layers on the emulsion layer side, measuring spectral absorption at the center of the sample using a spectrophotometer (U-3500, Hitachi) and determining evaluation according to the aforementioned criteria. In the measurement, a sample obtained by similarly treating a photothermographic material the same as the samples except that only the dye of the back layer was excluded was used as a control sample, and the measurement was performed for a measurement range of 350–900 nm.

The obtained results were similar to those shown in Table 3.

(Evaluation of Storability after Development: Unevenness of Gloss and Handling Property)

Ten sheets of each sample developed in the aforementioned evaluations (standard evaluations of photographic performance) were stacked so that the emulsion layers and the back layers could be brought into contact with each other, and stored in an environment at a temperature of 50° C. and a relative humidity of 60% for 7 days in a sealed state. Then, the package was opened and the sheets were peeled one by one to perform a sensory evaluation of images. Workability for the operation of peeling the stacked sheets one by one (partial adhesion of samples etc.) was evaluated according to the following relative evaluation criteria by using Sample 102 and Sample 202 as standards for Samples 101–110 and Samples 201–210, respectively.

◎: There was obtained a result equivalent to that of the standard sample immediately after development, and there was no problem for practical use.

○: There was obtained a slightly worse result compared with the standard sample immediately after development, but there was no problem for practical use.

X: There was obtained a markedly worse result, which was problematic for practical use.

Further, each sample was observed from the back surface side by visual inspection to evaluate unevenness of gloss according to the following relative criteria using the same standard samples as mentioned above immediately after development.

◎: There was obtained a result equivalent to that of the standard sample immediately after development, and there was no problem for practical use.

○: There was obtained a slightly worse result compared with the standard sample immediately after development, but there was no problem for practical use.

X: There was obtained a markedly worse result, which was problematic for practical use.

The results are shown in Tables 5 and 6 mentioned below.

TABLE 5

| Sample No. | Degradation of definition | Residual color evaluated by visual inspection (cf. Table 3) | Handling property after storage | Unevenness of gloss after storage | Note |
|---|---|---|---|---|---|
| 101 | 100 | ◎ | ◎ | ◎ | Invention |
| 102 | 95 | ◎ | ◎ | ◎ | Invention |
| 103 | 90 | ◎ | ◎ | ◎ | Invention |
| 104 | 100 | X | ◎ | ◎ | Comparative |
| 105 | 100 | ○ | ○ | X | Comparative |
| 106 | 95 | ○ | ○ | X | Comparative |
| 107 | 90 | X | X | X | Comparative |
| 108 | 120 | ◎ | ◎ | ◎ | Comparative |

TABLE 5-continued

| Sample No. | Degradation of definition | Residual color evaluated by visual inspection (cf. Table 3) | Handling property after storage | Unevenness of gloss after storage | Note |
|---|---|---|---|---|---|
| 109 | 100 | X | ◎ | ◎ | Comparative |
| 110 | 95 | X | ◎ | ◎ | Comparative |

TABLE 6

| Sample No. | Degradation of definition | Residual color evaluated by visual inspection (cf. Table 3) | Handling property after storage | Unevenness of gloss after storage | Note |
|---|---|---|---|---|---|
| 201 | 100 | ◎ | ◎ | ◎ | Invention |
| 202 | 95 | ◎ | ◎ | ◎ | Invention |
| 203 | 90 | ◎ | ◎ | ◎ | Invention |
| 204 | 100 | X | ◎ | ◎ | Comparative |
| 205 | 100 | ○ | ○ | X | Comparative |
| 206 | 95 | ○ | ○ | X | Comparative |
| 207 | 90 | X | X | X | Comparative |
| 208 | 120 | ◎ | ◎ | ◎ | Comparative |
| 209 | 100 | X | ◎ | ◎ | Comparative |
| 210 | 95 | X | ◎ | ◎ | Comparative |

From the above result, it was found that Photothermographic materials 101 to 103 and 201 to 203 according to the present invention were excellent in all of definition of image, residual color and storability after development. In addition, it was found that Photothermographic materials 105 to 107 and 205 to 207, which were improved versions of Photothermographic materials 104 and 204, respectively, for residual color, were worse in respect of storability after development. Furthermore, Photothermographic material 108 to 110 and 208 to 210 could not reconcile the definition and residual color in spite of the use of dyes showing sharp absorbance, because the maximum absorption wavelengths of the dyes were out of the range defined by the present invention.

Example 3

An undercoated support that was the same as the one used for the preparation of Support A2 having a back layer prepared in Example 1 was used, provided that it was not undercoated, i.e., the coating solution for protective layer of photosensitive layer side was not coated. The emulsion layer side of this support was coated in the same manners as used for the photothermographic materials described in JP-A-7-13294, page 7, Example 1 to obtain Photothermographic materials 301 and 302.

Each photothermographic material was exposed by using a light exposure apparatus provided with a He—Ne laser of 10 mW and subjected to heat treatment at 127° C. for 17 seconds. As a result, the both samples provided clear images. Further, images that could be used for appreciation as visible images could be obtained without delaminating the antihalation layer.

Example 4

Photothermographic materials 401 to 403 were produced in the same manner as in Example 2 except that Dye dispersion 101 was added in an amount of 0.01 g/m$^2$ in terms of solid content of the dye instead of 0.036 g/m$^2$ of the pigment (C. I. Pigment Blue 60) contained in the emulsion layers of the Photothermographic materials 201 to 203, respectively. The obtained samples were evaluated in the same manner as in Example 2. As a result, images excellent in all of definition, residual color and storability after development were obtained with all the samples.

What is claimed is:

1. A photothermographic material having a support, at least one photosensitive layer containing a silver halide and a reducing agent and a non-photosensitive layer containing aggregates of a cyanine dye, wherein a transmission absorption spectrum of the aggregates has a maximum absorption wavelength within the range of 600–750 mm.

2. The photothermographic material according to claim 1, wherein a transmission absorption spectrum of the aggregates has a maximum absorption wavelength within the range of 620–700 nm.

3. The photothermographic material according to claim 1, wherein the maximum absorbance peak in the transmission absorption spectrum of the aggregates has a half band width of 100 nm or less.

4. The photothermographic material according to claim 1, wherein the maximum absorbance peak in the transmission absorption spectrum of the aggregates has a half band width of 80 nm or less.

5. The photothermographic material a according to claim 1, wherein the maximum absorbance peak in the transmission absorption spectrum of the aggregates has a half band width of 40 nm or less.

6. The photothermographic material a according to claim 1, wherein the maximum absorbance peak in the transmission absorption spectrum of the aggregates has a half band width of 25 nm or less.

7. The photothermographic material according to claim 1, wherein the aggregates show a maximum absorbance of 0.13 or less for a light having a wavelength of 400–600 nm before and after a heat development.

8. The photothermographic material according to claim 1, wherein the aggregates show a maximum absorbance of 0.10 or less for a light having a wavelength of 400–600 nm before and after a heat development.

9. The photothermographic material according to claim 1, wherein the aggregates show an absorbance of 0.2 or more for a light having a wavelength for light exposure.

10. The photothermographic material according to claim 1, wherein the aggregates of the dye have a maximum absorption wavelength which differs from the maximum absorption wavelength of the dye in the non-aggregated state by 30 nm or more.

11. The photothermographic material according to claim 1, wherein the aggregates of the dye have a maximum absorption wavelength which differs from the maximum absorption wavelength of the dye in the non-aggregated state by 40 nm or more.

12. The photothermographic material according to claim 1, wherein the aggregates of the dye have a maximum absorption wavelength which differs from the maximum absorption wavelength of the dye in the non-aggregated state by 45 nm or more.

13. The photothermographic material according to claim 1, wherein the photosensitive layer is disposed on a laminate of the non-photosensitive layer and the support.

14. The photothermographic material a according to claim 1, wherein the non-photosensitive layer contains the aggregates in the form of aqueous microparticles containing hydrophilic colloid.

15. The photothermographic material according to claim 1, which contains a non-photosensitive silver source.

16. The photothermographic material according to claim 1, wherein a transmission absorption spectrum of the aggregates has a maximum absorption wavelength within the range of 600–720 nm.

17. The photothermographic material according to claim 1, wherein the aggregates show a maximum a adsorbance of 0.15 or less for a light having a wavelength of 400–600 nm before and after a heat development.

* * * * *